US010718075B2

(12) United States Patent
Lonati et al.

(10) Patent No.: US 10,718,075 B2
(45) Date of Patent: Jul. 21, 2020

(54) METHOD FOR PREPARING A TUBULAR ARTICLE, SUCH AS A SOCK OR THE LIKE, FOR AUTOMATED PICKUP AT THE END OF ITS FORMING ON A DOUBLE CYLINDER CIRCULAR MACHINE WITH AT LEAST ONE FEED OR DROP, AND DOUBLE CYLINDER CIRCULAR MACHINE FOR THE EXECUTION THEREOF

(71) Applicant: Lonati S.P.A., Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 0 days.

(21) Appl. No.: 15/775,141

(22) PCT Filed: Nov. 4, 2016

(86) PCT No.: PCT/EP2016/076729

§ 371 (c)(1),
(2) Date: May 10, 2018

(87) PCT Pub. No.: WO2017/080931

PCT Pub. Date: May 18, 2017

(65) Prior Publication Data

US 2018/0340276 A1 Nov. 29, 2018

(30) Foreign Application Priority Data

Nov. 11, 2015 (IT) ..... 102015000071276

(51) Int. Cl.
*D04B 9/10* (2006.01)
*D04B 9/40* (2006.01)

(52) U.S. Cl.
CPC *D04B 9/40* (2013.01); *D04B 9/10* (2013.01)

(58) Field of Classification Search
CPC ..... D04B 9/40; D04B 15/02; D04B 15/88; D04B 9/46; D04B 9/56; D04B 9/10
(Continued)

(56) References Cited

U.S. PATENT DOCUMENTS 4,233,822 A * 11/1980 Lonati ..... D04B 9/10 66/104
6,164,091 A * 12/2000 Frullini ..... D04B 9/40 66/148

(Continued)

FOREIGN PATENT DOCUMENTS

CN 103946432 A 7/2014
CO 20140080249 4/2014

(Continued)

OTHER PUBLICATIONS

Office Action related to Columbian Application No. NC2018/0002821, dated Apr. 29, 2019 (8pgs.).

(Continued)

*Primary Examiner* — Danny Worrell
(74) *Attorney, Agent, or Firm* — Husch Blackwell LLP

(57) ABSTRACT

A method for preparing a tubular article, such as a sock or the like, for automated pickup at the end of its forming on a double cylinder circular machine with at least one feed or drop, and to a double cylinder circular machine for the execution thereof. The method in question is executed on a machine with at least one feed or drop (100) and with the needle cylinders (4, 5) actuatable with a rotary motion about their own axes (3) with respect to needle actuation cams, to cams (34) for actuating the knockover sinkers (33) and to the feed or drop (100). The method comprises:

a first step, which consists in transferring or retaining all the needles (8) in the lower needle cylinder (4) with the (Continued)

loops of the last row of knitting of the article (80), formed previously in the upper head (9*a*) of the needles (8), hooked, tensioning the article (80) downward inside the lower needle cylinder (4);

a second step, which consists in pushing upward the portion of the article (80) engaged with the needles (8);

a third step, which consists in moving all the needles (8) to the tuck stitch position;

a fourth step, which consists in progressively disengaging the knockover sinkers (33) from the article (80), moving the knockover sinkers (33) away from the axis (3) of the lower needle cylinder (4) at the feed or drop (100) owing to the rotation of the lower needle cylinder (4) about its own axis (3) with respect to the feed or drop (100) and to the needle actuation cams so that the article (80), owing to the upward thrust, moves so that the loops of its last row of knitting (80*a*) lie above the beak (33*b*) of the knockover sinkers (33) toward the upper head (9*a*) of the needles (8);

a fifth step, which consists in moving all the needles (8) to an intermediate position that is comprised between the tuck stitch position and the drop stitch position;

a sixth step, which consists in pushing the portion of the article (80) that is engaged with the needles (8) further upward;

a seventh step, which consists in lifting the needles (8) at least to the drop stitch position, keeping the article (80) pushed upward in order to retain the loops of the last row of knitting (80*a*) in the upper head (9*a*) of the needles (8).

7 Claims, 27 Drawing Sheets

(58) Field of Classification Search
USPC ..... 66/147, 148, 149 R, 150
See application file for complete search history.

(56) References Cited

U.S. PATENT DOCUMENTS

| | | | | |
|---|---|---|---|---|
| 6,220,061 | B1 * | 4/2001 | Ando | D04B 9/10 66/123 |
| 6,223,564 | B1 | 5/2001 | Lonati et al. | |
| 6,282,925 | B1 * | 9/2001 | Ando' | D04B 15/92 66/148 |
| 6,296,159 | B1 | 10/2001 | De Giovanni | |
| 6,698,250 | B2 * | 3/2004 | Lonati | D04B 9/10 66/148 |
| 6,705,128 | B1 | 3/2004 | Sciacca | |
| 7,975,513 | B2 * | 7/2011 | Lonati | D04B 15/92 66/148 |
| 9,365,962 | B2 * | 6/2016 | Lonati | D04B 9/10 |
| 2001/0052248 | A1 * | 12/2001 | Ando' | D04B 9/56 66/148 |
| 2010/0319408 | A1 | 12/2010 | Lonati et al. | |
| 2015/0000348 | A1 | 1/2015 | Lonati et al. | |
| 2015/0354408 | A1 | 12/2015 | Snyder | |

FOREIGN PATENT DOCUMENTS

| | | | |
|---|---|---|---|
| EP | 0 942 086 | A2 | 9/1999 |
| EP | 0942086 | | 9/1999 |
| EP | 1 010 790 | A2 | 6/2000 |
| EP | 1010790 | | 6/2000 |
| KR | 20140067130 | | 6/2014 |
| WO | WO13/041268 | | 3/2013 |
| WO | WO 2013/041268 | A1 | 3/2013 |

OTHER PUBLICATIONS

Translation Summary of Office Action related to Columbian Application No. NC2018/0002821, dated Apr. 29, 2019, Summary dated May 24, 2019 (4pgs.).
Italian Search Report and Written Opinion from IT UB20155479.
Korean Office Action related to Application No. 10-2018-7010505, dated Jun. 14, 2019 (4 pgs.).
English summary of Korean Office Action related to Application No. 10-2018-7010505, dated Jun. 14, 2019 (3 pgs.).
English Translation of the Preliminary Office Action Report Related to Patent Application No. BR112018005658-8.
English language translation of Bibliographic Data and Abstract of CN103946432 (A).

* cited by examiner

METHOD FOR PREPARING A TUBULAR ARTICLE, SUCH AS A SOCK OR THE LIKE, FOR AUTOMATED PICKUP AT THE END OF ITS FORMING ON A DOUBLE CYLINDER CIRCULAR MACHINE WITH AT LEAST ONE FEED OR DROP, AND DOUBLE CYLINDER CIRCULAR MACHINE FOR THE EXECUTION THEREOF

The present invention relates to a method for preparing a tubular article, such as a sock or the like, for automated pickup at the end of its forming on a double cylinder circular machine with at least one feed or drop, and to a double cylinder circular machine for the execution thereof.

BACKGROUND OF THE INVENTION

In the international patent application WO2009/112346 A1 of this same applicant, an apparatus and a method are described for executing the closure of a knitted tubular article at an axial end thereof, at the end of its production cycle on a circular machine for knitting, hosiery or the like.

Such method consists substantially of removing the article, at the end of its production, from the needles of the machine by way of a pickup device and of transferring the article to a region arranged laterally to the needle cylinder of the machine where there is a handling device, which receives the article from the pickup device and brings together the two flaps of the axial end of the article to be closed, and a sewing head, which performs the joining of these two flaps thus carrying out the closure of the axial end of the article.

The pickup device described in such international patent application and the subject matter of international patent application WO2009/112347 A1 comprises an annular body that can be arranged coaxially around the upper end of the needle cylinder of a single-cylinder circular machine for knitting or for hosiery and which supports, inside radial grooves, pickup elements that are moveable on command radially and are each engageable, by way of the end thereof directed toward the axis of the annular body, with the shank of a needle of the machine, below the latch, so as to receive in such end, which is barb-shaped with the point directed upward, the last loop of knitting of the article formed by such needle when this is pushed downward below the latch. The subsequent movement of the pickup device upward causes the closure of the latches on the head of the needles and the disengagement of the article from the needles of the machine.

In order to carry out the picking up of the article from the needles of the machine by way of the pickup device of the type described in the international patent applications cited above, it is necessary that the needles of the machine be lifted in the "drop stitch" position and that the last row of knitting formed be held in the heads of the needles without passing below the latches of the needles.

Theoretically, the pickup device described above can also be used for carrying out the picking up of the article from double-cylinder circular machines, by arranging the article inside the lower needle cylinder and bringing the loops of the last row of knitting in the upper head of the needles that are arranged in the lower needle cylinder and which are conveniently lifted so as to permit the engagement of the pickup elements with their shank below the upper latch of those same needles after the upper needle cylinder has been moved away from the lower needle cylinder.

Application of this pickup device to single-cylinder circular machines for hosiery, in order to carry out the automated closure of the toe of socks, has not raised problems, while its application to double-cylinder circular machines for hosiery has been more problematic, mainly owing to the difficulty of successfully positioning the article with the loops of the last row of knitting formed in the upper head of the needles arranged in the lower needle cylinder to the drop stitch position in order to allow a simple and exact coupling with the pickup elements of the pickup device described above below the upper latch of the needles.

In fact, in double-cylinder circular machines for hosiery, the presence of the knockover sinkers, typically curved, opposes the lifting of the article together with the lifting of the needles to the drop stitch position in order to safely prevent the loops of the last row of knitting from passing below the upper latch of the needles arranged in the lower needle cylinder.

In double-cylinder circular machines for hosiery, differently from single-cylinder circular machines for hosiery, the knockover sinkers are driven by actuation cams that are fixed to a supporting element that is arranged inside the lower needle cylinder and which is integral with the supporting structure of the machine as regards the rotation movement about the axis of the lower needle cylinder, not considering oscillations of reduced extent in order to anticipate or retard their intervention on the knockover sinkers. These actuation cams define a path within which a heel of the knockover sinkers, also referred to hereinbelow as "sinkers" for the sake of simplicity, engages, and such path is contoured so as to cyclically cause, by virtue of the rotation of the sinkers together with the lower needle cylinder about its own axis with respect to the supporting structure and therefore to the actuation cams of the sinkers, an approach and a distancing of the beak of each sinker with respect to the axis of the lower needle cylinder so as to cooperate with the contiguous needles in the forming of the knitting. The path defined by the actuation cams of the sinkers is such as to cause a distancing of the beak of the sinkers from the axis of the lower needle cylinder at each feed or drop of the machine and such as to cause an approach of the beak of the sinkers to the axis of the lower needle cylinder in the remaining part of the rotation of the lower needle cylinder about its own axis. For this reason, at the end of the forming of the last row of knitting of the article, the sinkers are engaged with the last row of knitting, except for the area at each feed or drop of the machine. This engagement of the sinkers with much of the last row of knitting of the article produced prevents the lifting of the article together with the needles of the machine in order to bring the needles of the machine to the drop stitch position and maintain or bring the loops of the last row of knitting formed to the upper head of the needles.

In international patent application WO2013/041268 A1 of this same applicant, a method is proposed which can solve this problem.

Such method, in the course of time, has been shown to be susceptible of improvements which are aimed mainly at simplifying the implementation of the machine.

The aim of the present invention is in fact to devise a method for preparing a tubular article of the type of a sock or the like for automated pickup at the end of its forming on a double cylinder circular machine with at least one feed or drop, which is capable of solving the above mentioned problem by using a double cylinder circular machine that is simpler, both to make and to operate, with respect to conventional machines, in particular simpler with respect to the machine illustrated in international patent application WO2013/041268 A1.

Within this aim, an object of the invention is to provide a double cylinder circular machine that is capable of executing the method according to the invention and which offers appreciable simplifications with respect to conventional machines, in particular with respect to the machine illustrated in international patent application WO2013/041268 A1.

Another object of the invention is to provide a method and a machine that make it possible to use, in order to carry out the automated removal of the article from the machine that produced it and transfer it to a station in which the closure is carried out of one axial end of that article, a pickup device provided with pickup elements which are engageable with the shank of the needles below the upper latch of the needles, in particular of the type described in international patent applications WO2009/112346 A1 and WO2009/112347 A1.

A further object of the invention is to provide a method and a machine that make it possible to perform the picking up of the article from the machine at the end of its production extremely precisely.

A further object of the invention is to provide a method and a machine that make it possible to perform the picking up of the article from the machine at the end of its production in a time that does not excessively penalize the production potential of the machine.

BRIEF SUMMARY OF THE INVENTION

This aim and these and other objects which will become better apparent hereinafter are achieved by a method for preparing a tubular article, such as a sock or the like, for automated pickup at the end of its forming on a double cylinder circular machine with at least one feed or drop and with the needle cylinders actuatable with a rotary motion about their own axes with respect to needle actuation cams, to cams for actuating the knockover sinkers, and to said feed or drop, characterized in that it comprises at least the following steps:

- a first step, which consists in transferring or retaining all the needles in the lower needle cylinder with the loops of the last row of knitting of the article, formed previously in the upper head of the needles, hooked, tensioning the article downward inside the lower needle cylinder;
- a second step, which consists in pushing upward the portion of the article engaged with the needles;
- a third step, which consists in moving all the needles to the tuck stitch position;
- a fourth step, which consists in progressively disengaging the knockover sinkers from the article, moving the knockover sinkers away from the axis of the lower needle cylinder at said feed or drop owing to the rotation of the lower needle cylinder about its own axis with respect to said feed or drop and to said needle actuation cams so that said article, owing to the upward thrust, moves so that the loops of its last row of knitting lie above the beak of the sinkers toward the upper head of the needles;
- a fifth step, which consists in moving all the needles to an intermediate position that is comprised between the tuck stitch position and the drop stitch position;
- a sixth step, which consists in pushing the portion of the article that is engaged with the needles further upward;
- a seventh step, which consists in lifting the needles at least to the drop stitch position, keeping the article pushed upward in order to retain the loops of the last row of knitting in the upper head of the needles.

The method according to the invention is preferably carried out using a double cylinder circular hosiery knitting machine which comprises a supporting structure which supports, so that it can rotate about its own, vertically oriented, axis, a lower needle cylinder and an upper needle cylinder, which can be positioned above and coaxially to the lower needle cylinder; a plurality of axial grooves being defined on the lateral surface of said lower needle cylinder and on the lateral surface of said upper needle cylinder; each one of the axial grooves of the lower needle cylinder, with said upper needle cylinder arranged coaxially to said lower needle cylinder, being aligned with an axial groove of the upper needle cylinder and accommodating a needle which can translate on command from said lower needle cylinder to said upper needle cylinder or vice versa; elements for actuating the corresponding needle when it is positioned in said lower needle cylinder being arranged in each one of the axial grooves of said lower needle cylinder, and elements for actuating the corresponding needle when it is positioned in said upper needle cylinder being arranged in each one of the axial grooves of said upper needle cylinder; actuation cams for the needles which are engageable with said actuation elements of the needles arranged in the axial grooves of said lower needle cylinder and of said upper needle cylinder being arranged around said lower needle cylinder and around said upper needle cylinder; sinkers being accommodated inside said lower needle cylinder and arranged with their beak between two contiguous axial grooves and movable with their beak toward or away with respect to the axis of the lower needle cylinder; actuation cams for the sinkers being provided which define at least one path that can be followed by a heel of the sinkers as a consequence of the rotation of the lower needle cylinder with respect to said actuation cams of the sinkers and which is contoured to move the sinkers with their beak toward or away with respect to the axis of the lower needle cylinder; said actuation elements of the needles arranged in the lower needle cylinder comprising, in each one of the axial grooves of the lower needle cylinder, a slider provided with an upper end that is engageable with the lower head of the corresponding needle and provided with a heel that protrudes from the lateral surface of the lower needle cylinder and is engageable with actuation cams of the sliders, which face the lateral surface of the lower needle cylinder; said actuation elements of the needles arranged in the lower needle cylinder comprising, in each one of the axial grooves of the lower needle cylinder, a connecting element which is connected, by way of the upper end thereof, to the corresponding slider arranged above said connecting element in said axial groove of the lower needle cylinder; said connecting element being provided with a movable heel which is directed toward the outside of the lower needle cylinder and being able to oscillate on a radial plane of the lower needle cylinder in order to engage, by way of said movable heel, with actuation cams of the connecting elements that face the lateral surface of the lower needle cylinder or in order to disengage from said actuation cams of the connecting elements; said actuation cams of the sliders comprising a set of knitting forming cams which is arranged at said feed or drop and is composed of two knockover cams which are arranged on mutually opposite sides with respect to a central plane that passes through the axis of the lower needle cylinder and a central cam which is arranged above said knockover cams between said knockover cams; characterized in that said actuation cams of the connecting elements comprise at least one cam for lifting the needles to the tuck stitch position and at least one cam for lifting the needles to the dropped stitch position, said at least one cam for lifting the needles to the tuck stitch position, said at least one cam for lifting the needles to the dropped stitch position and said knockover cams being fixed, with respect to a corresponding lower cam support which is fixed to the supporting structure of the machine, as regards a radial displacement with respect to the lower needle cylinder, said central cam being movable on command toward or away from the axis of the lower needle cylinder with respect to said lower cam support in order to interfere or not interfere with the heel of the sliders.

BRIEF DESCRIPTION OF THE SEVERAL VIEWS OF THE DRAWINGS

Further characteristics and advantages of the invention will become better apparent from the detailed description that follows of a preferred, but not exclusive, embodiment of the method according to the invention, as well as of the machine for its execution, which is illustrated for the purposes of non-limiting example in the accompanying drawings wherein.

Figure 6:
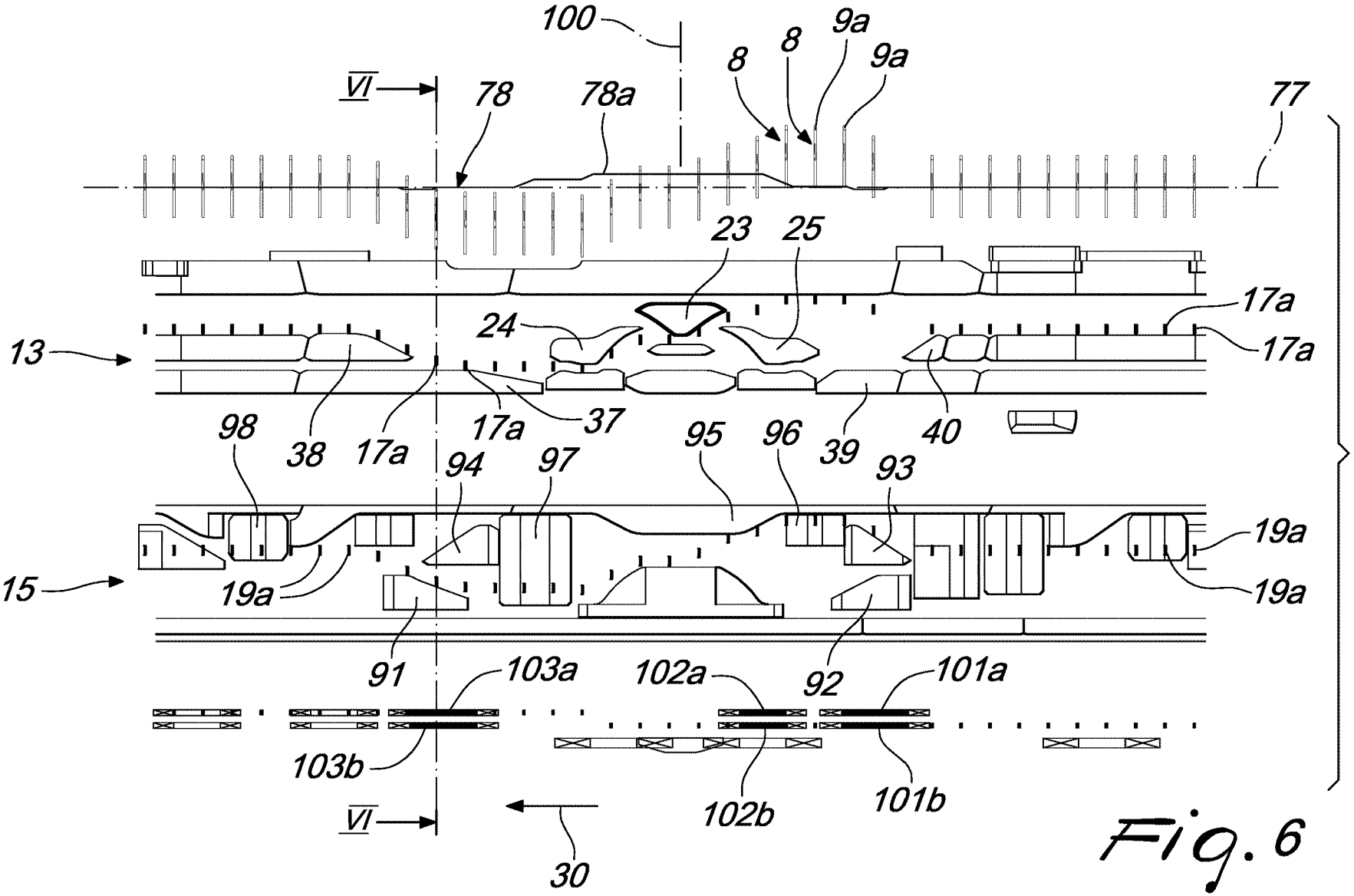
Figure 6A:
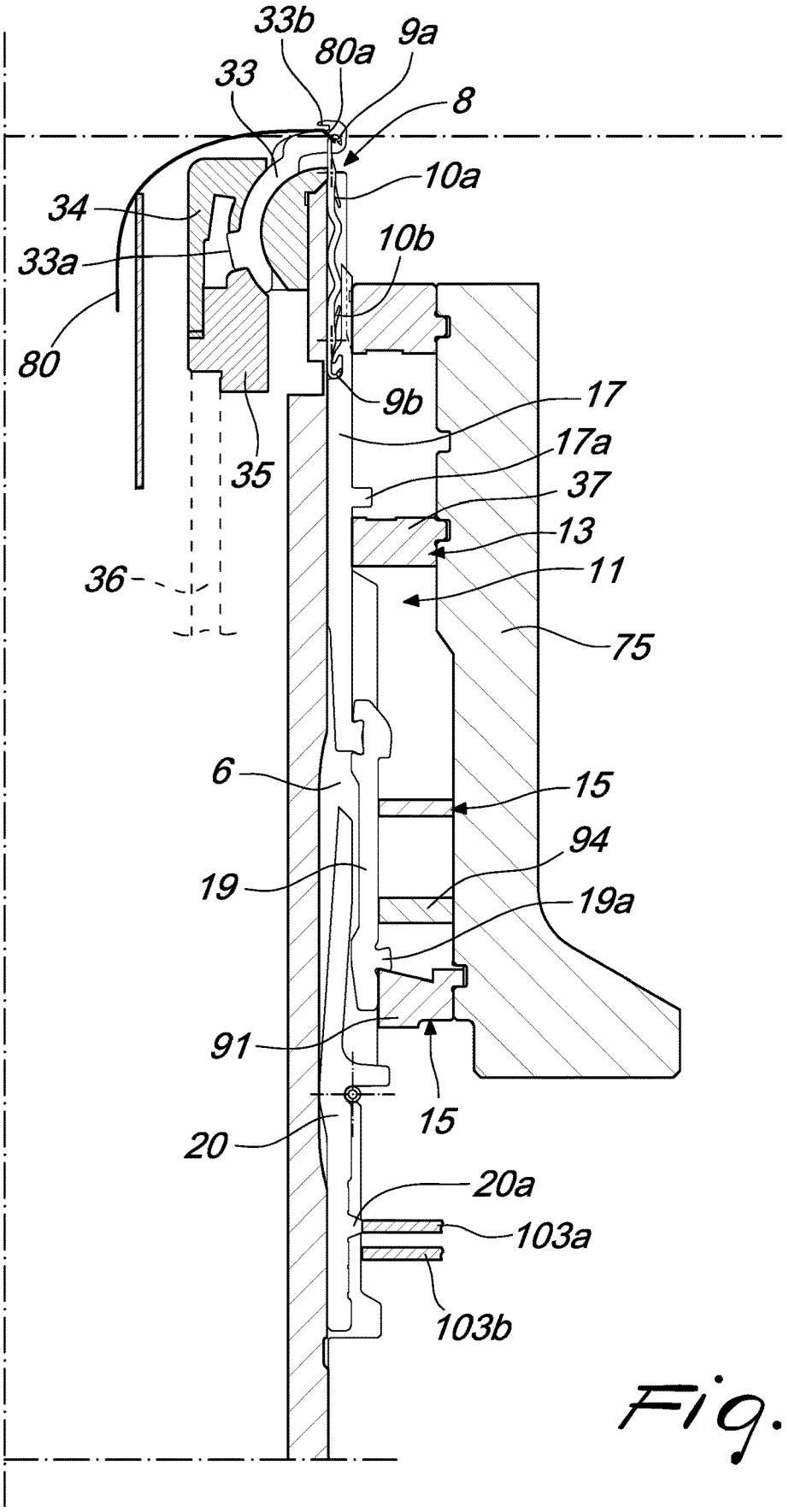
Figure 7:
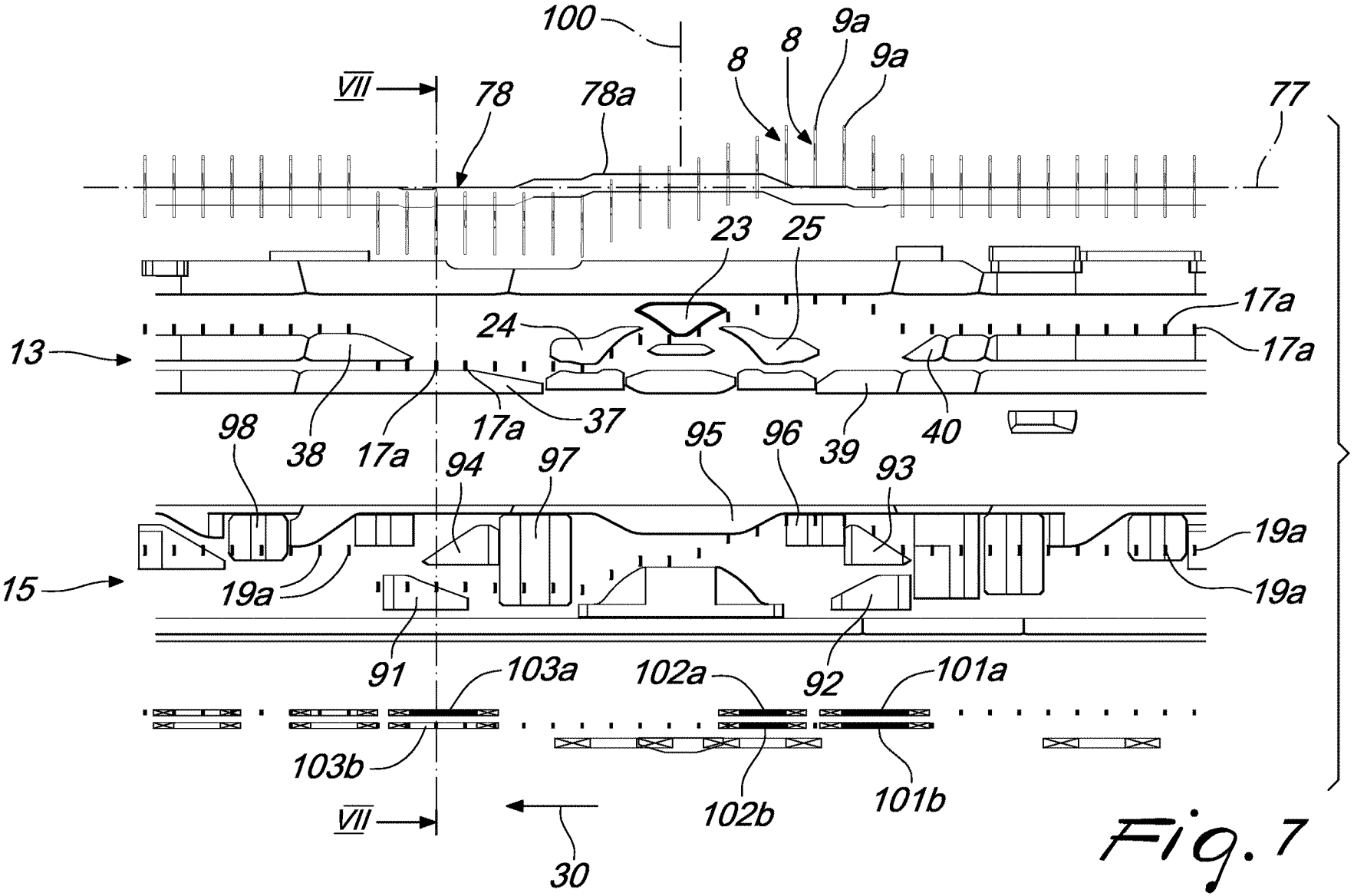
Figure 7A:
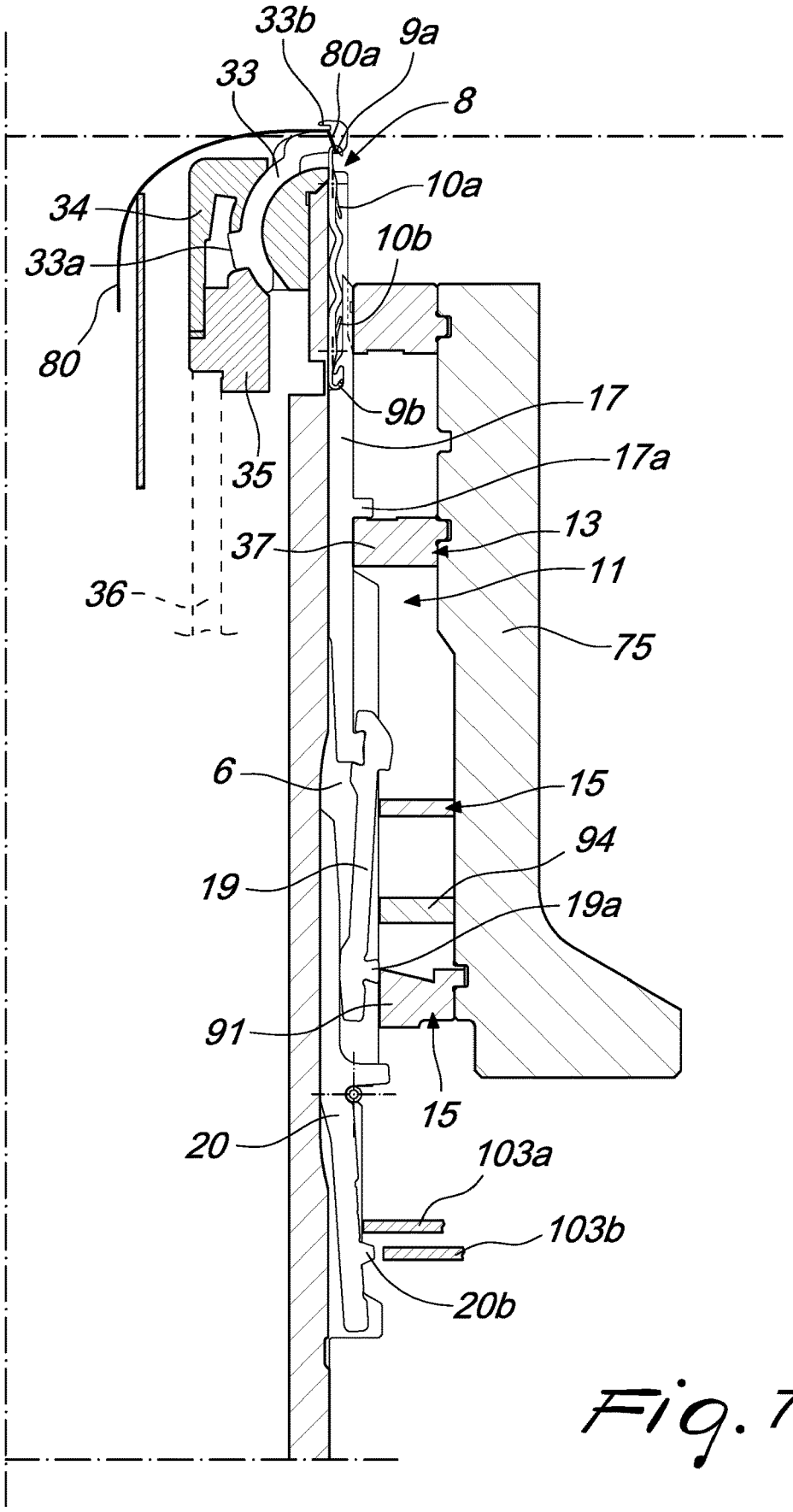
Figure 8:
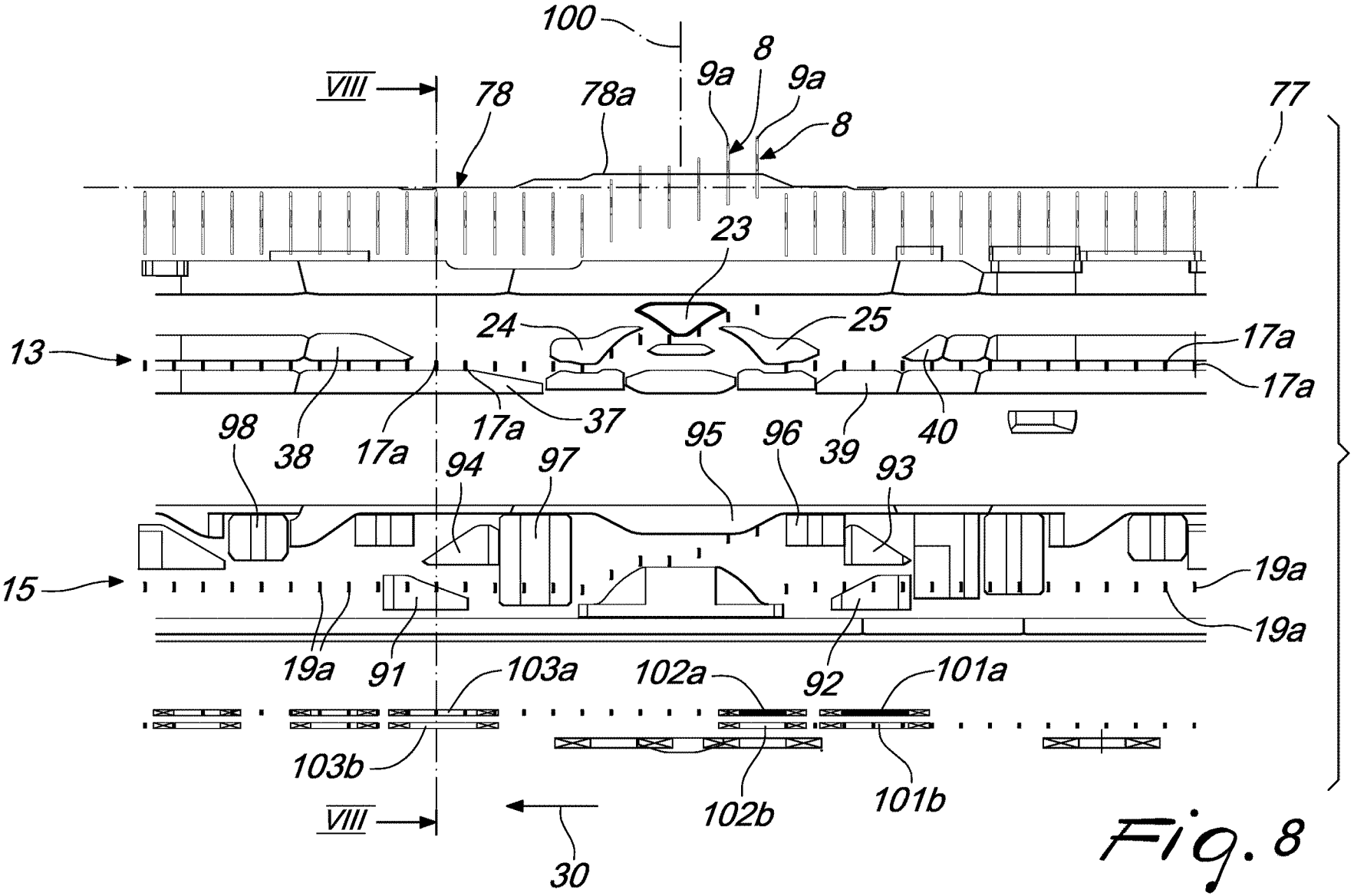
Figure 8A:
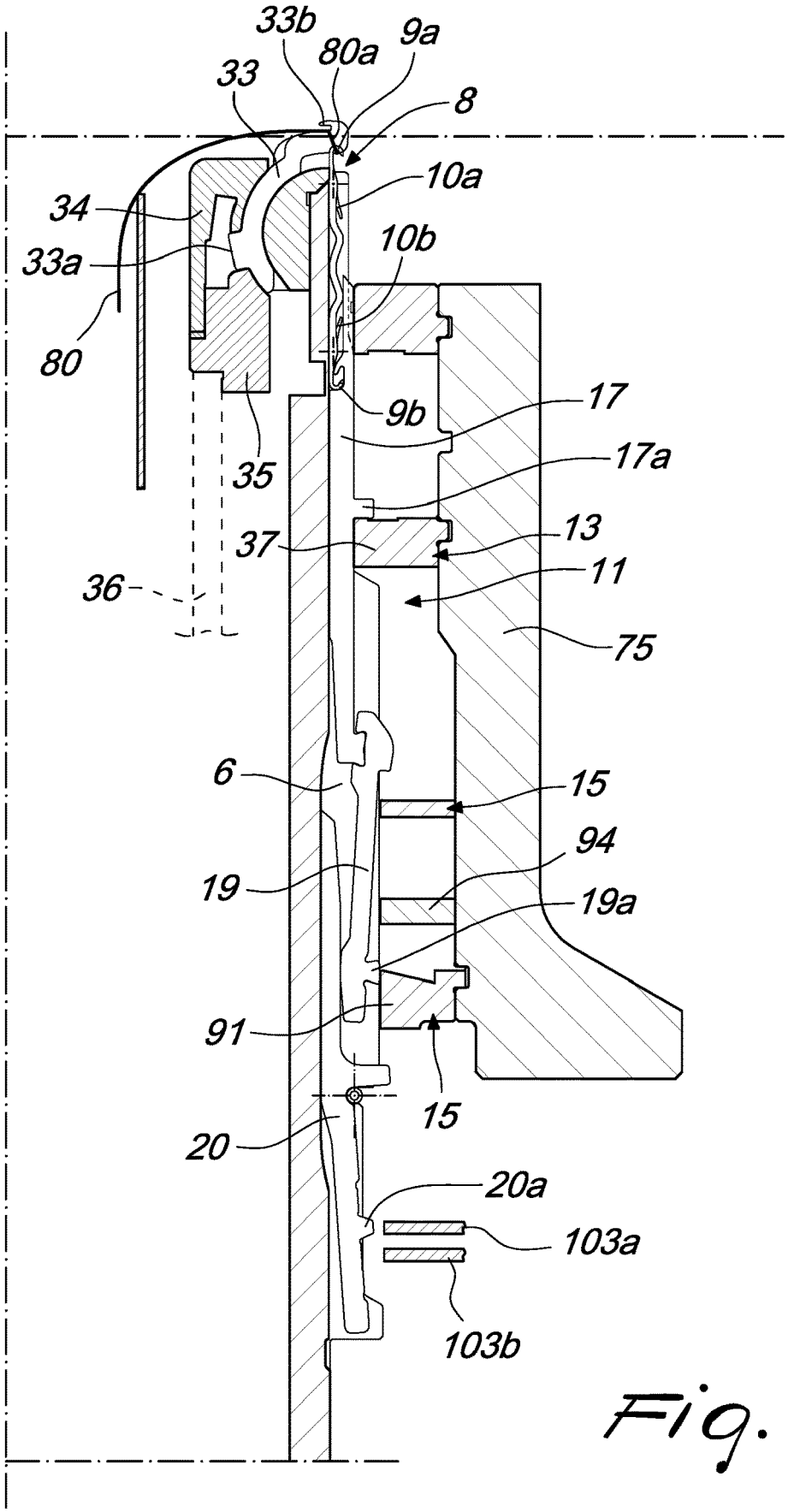
Figure 9:
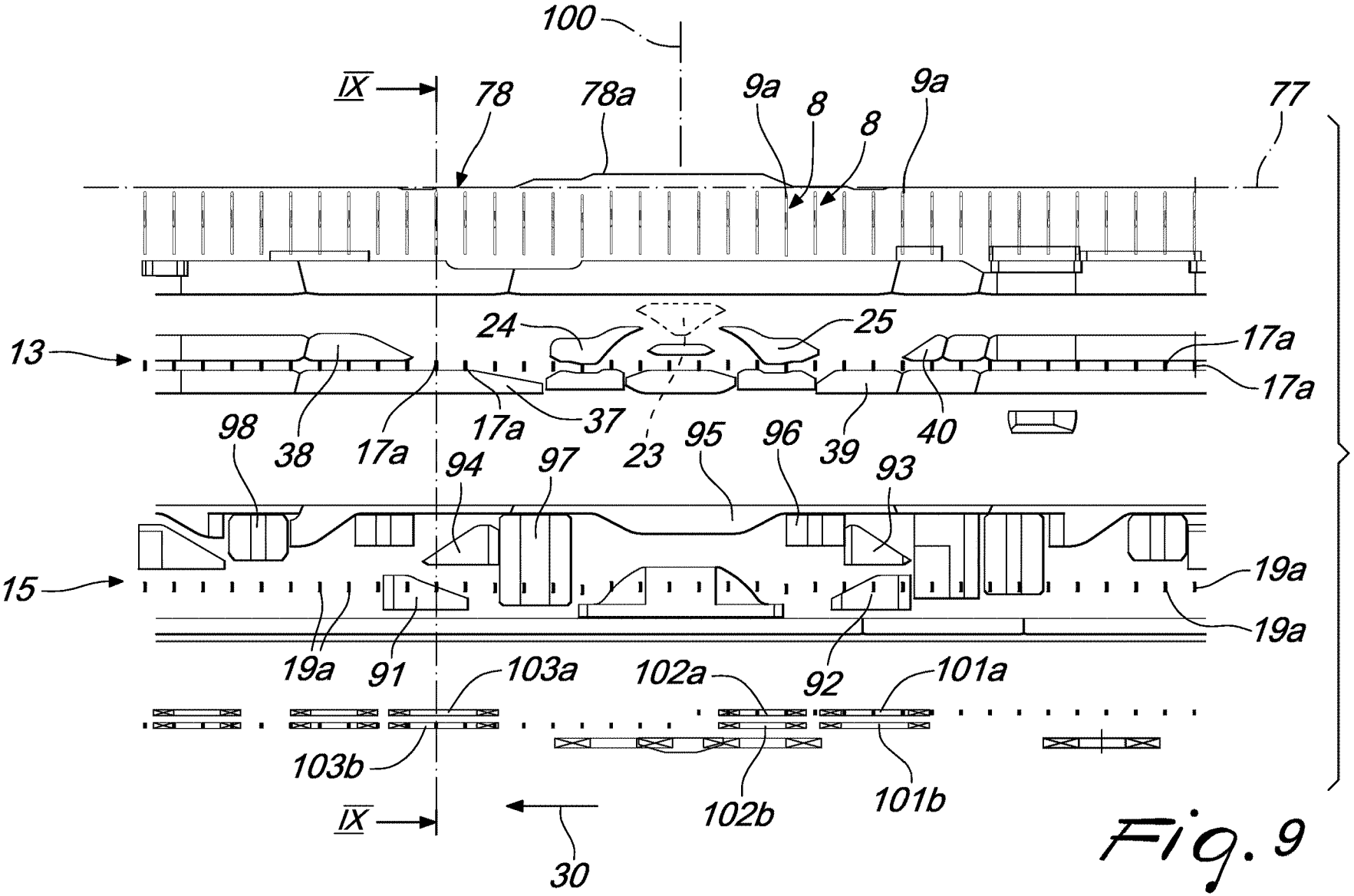
Figure 9A:
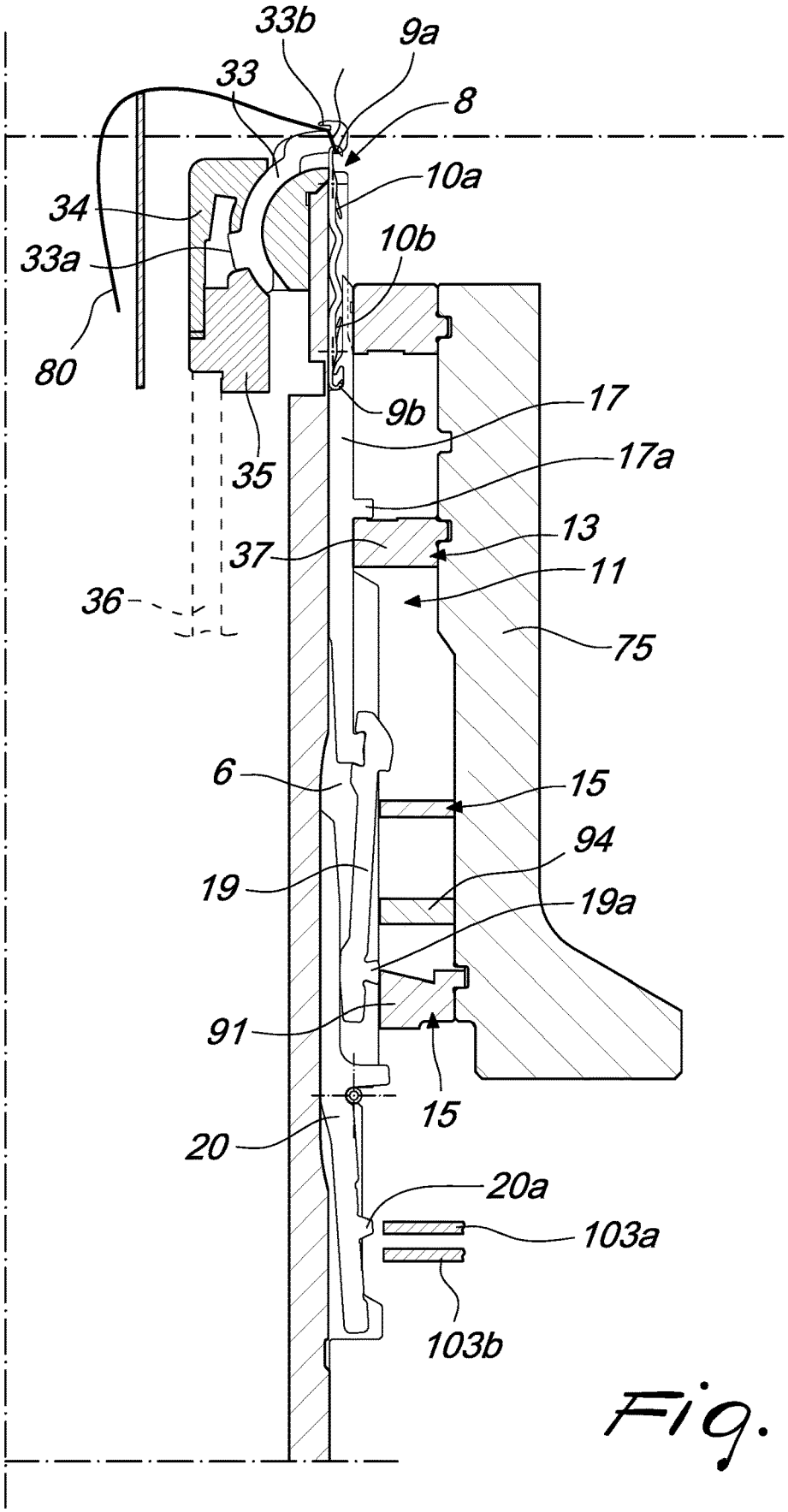
Figure 10:
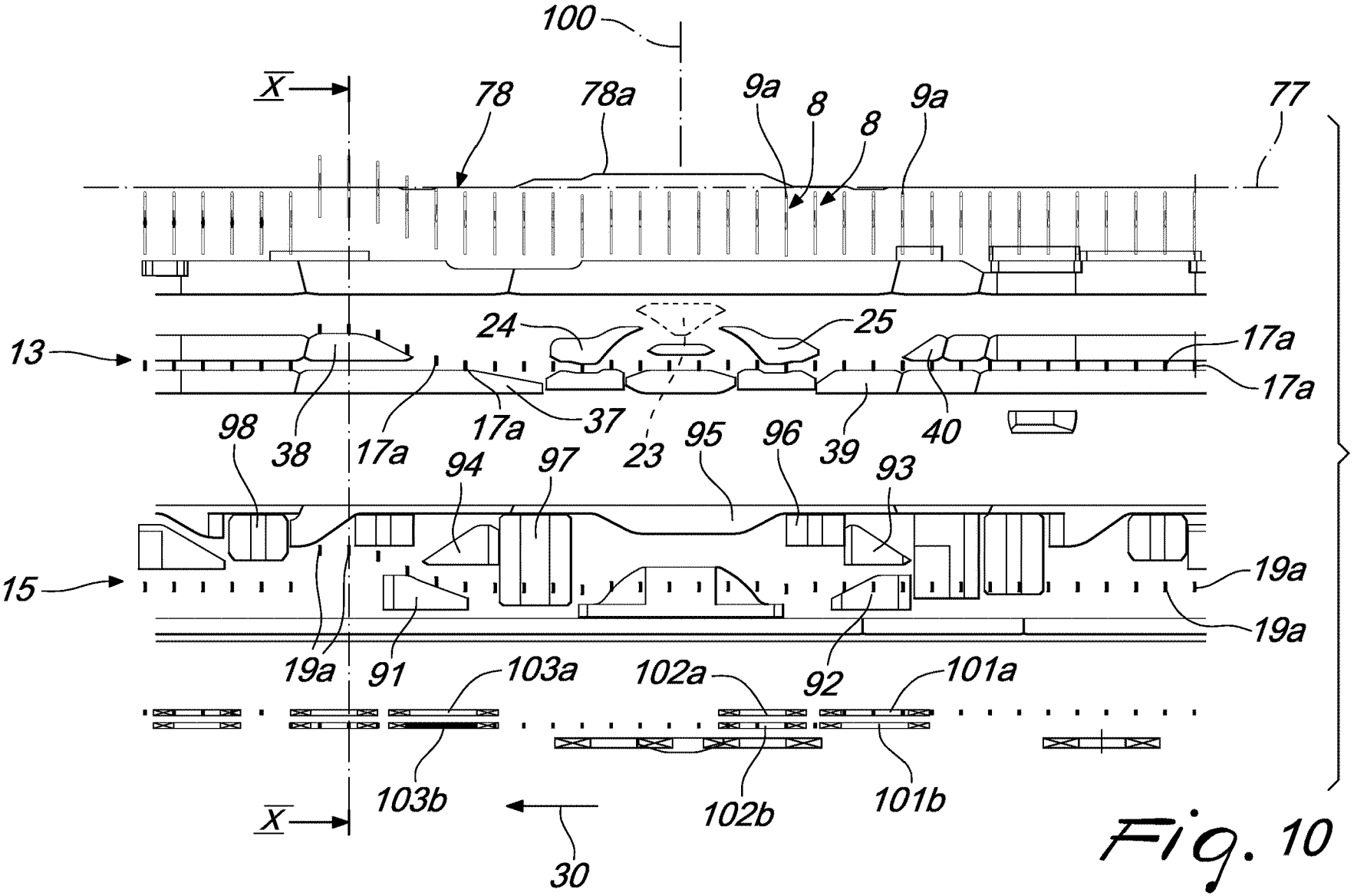
Figure 10A:
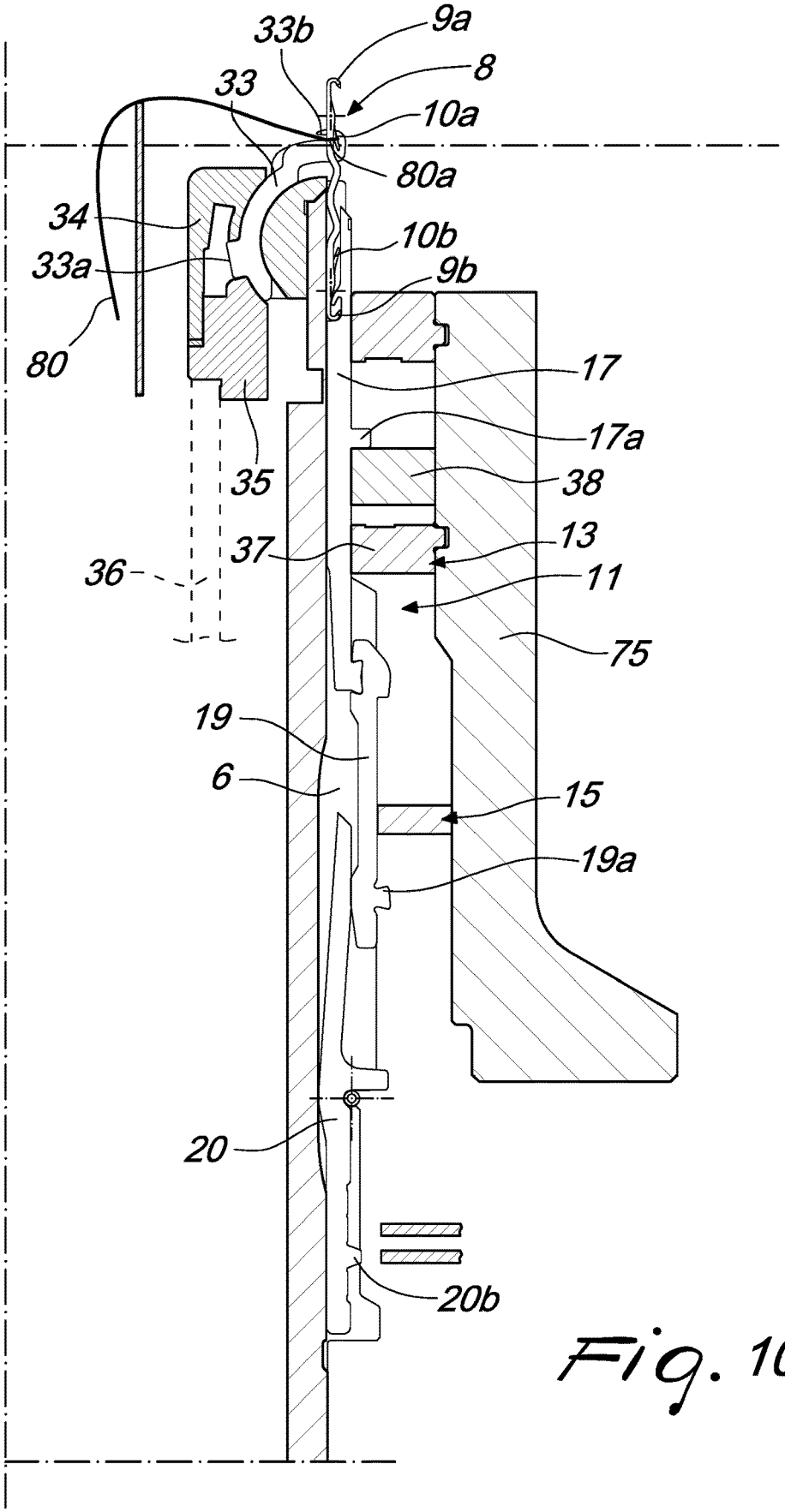
Figure 11:
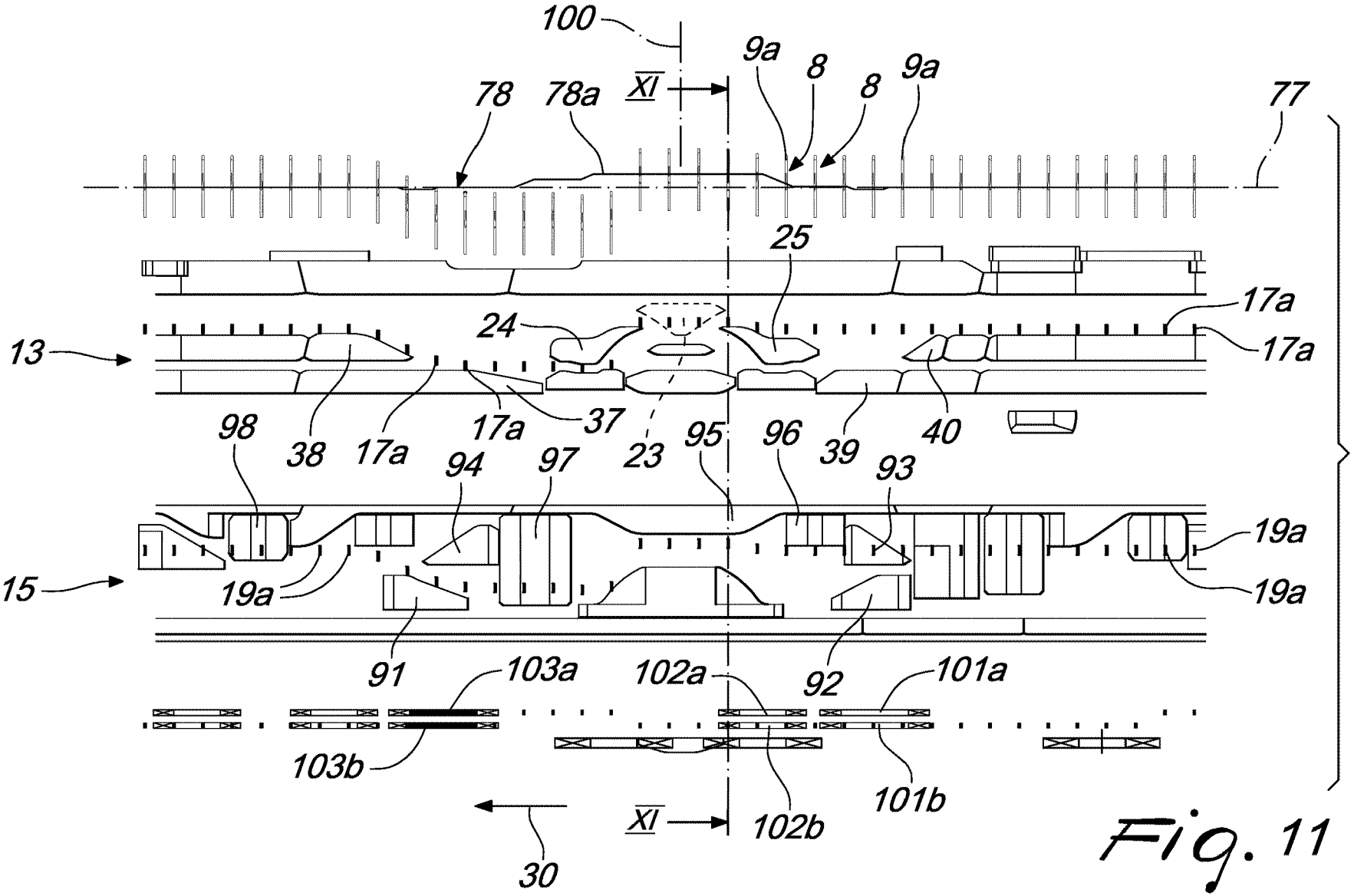
Figure 11A:
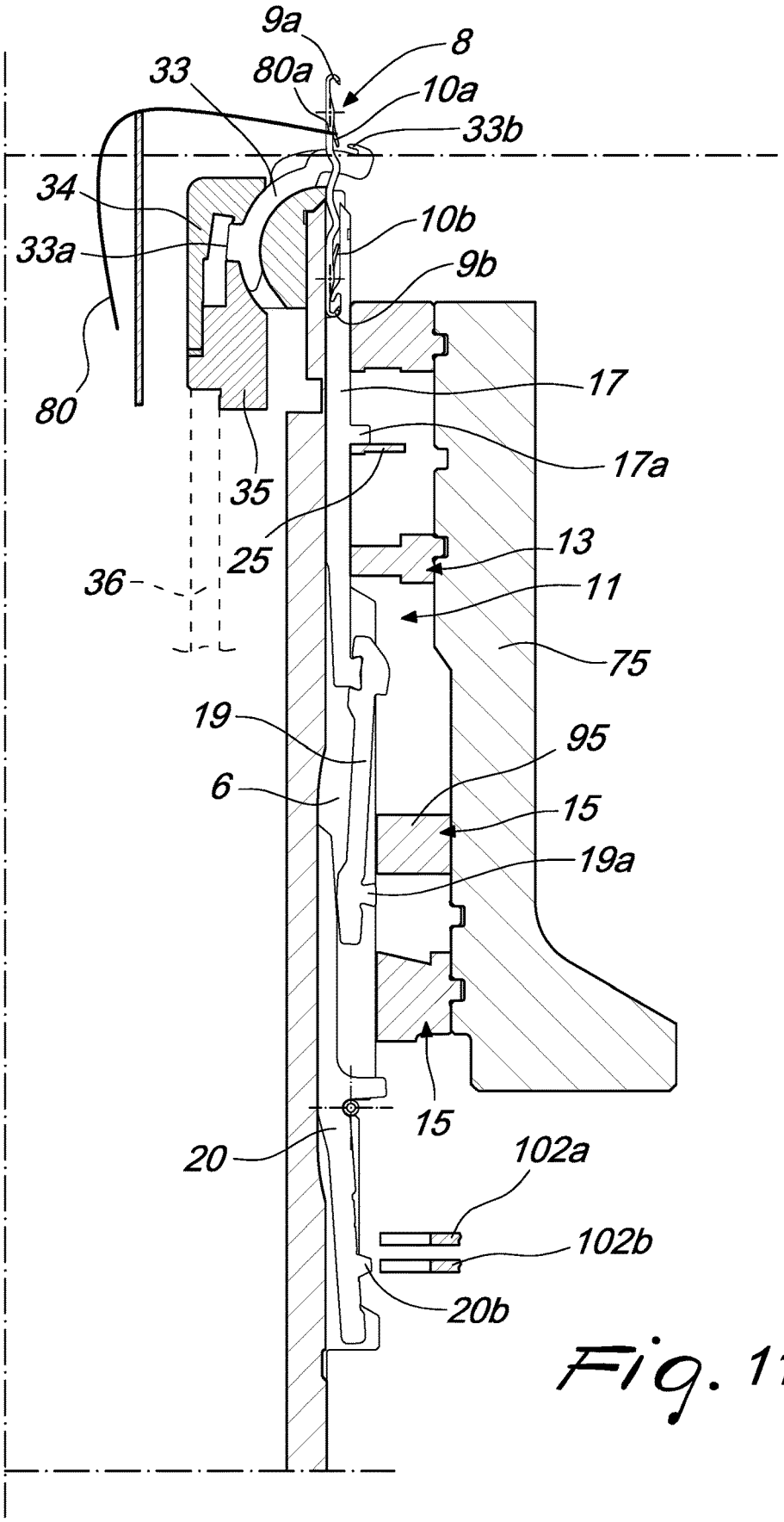
Figure 12:
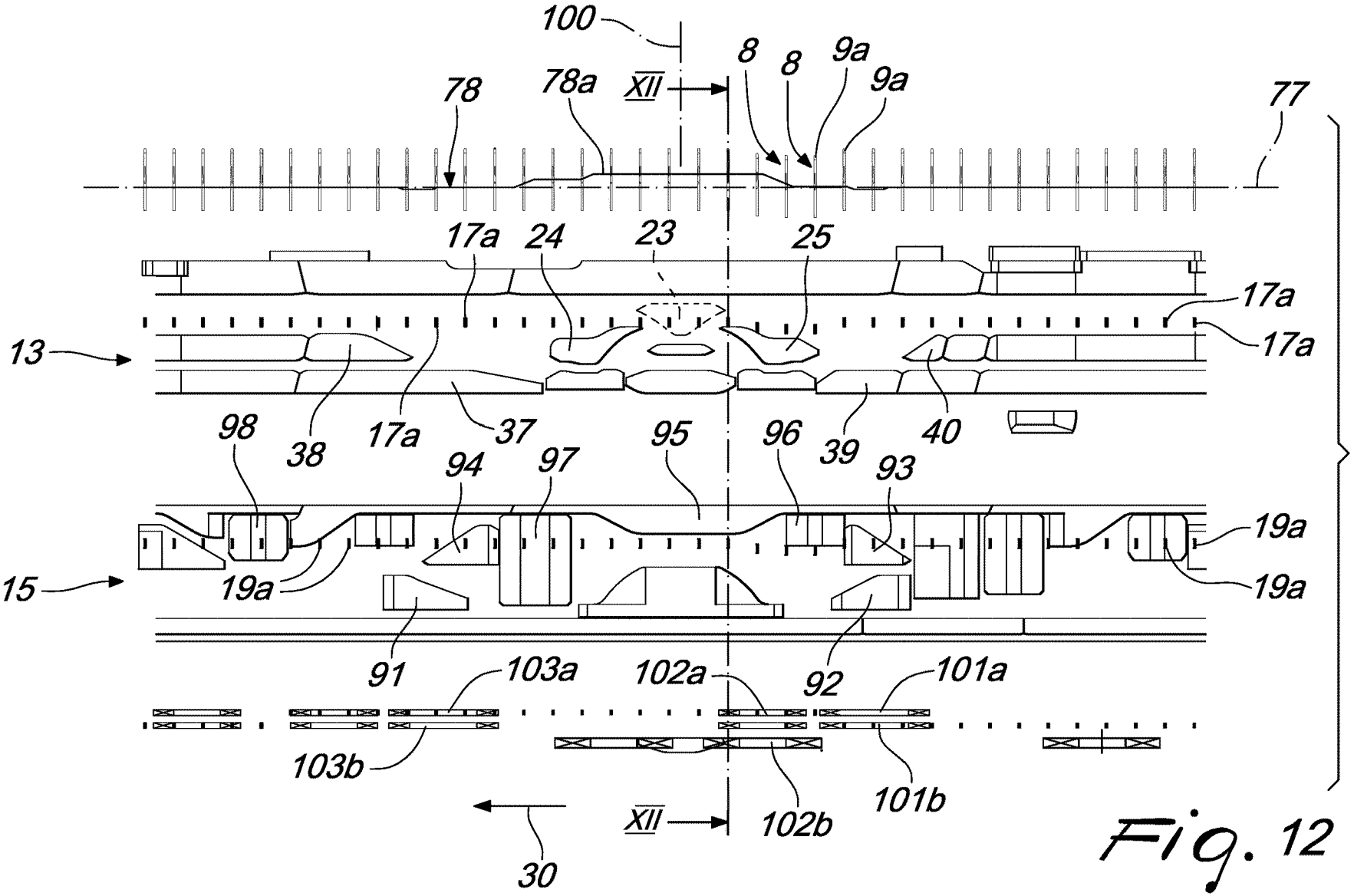
Figure 12A:
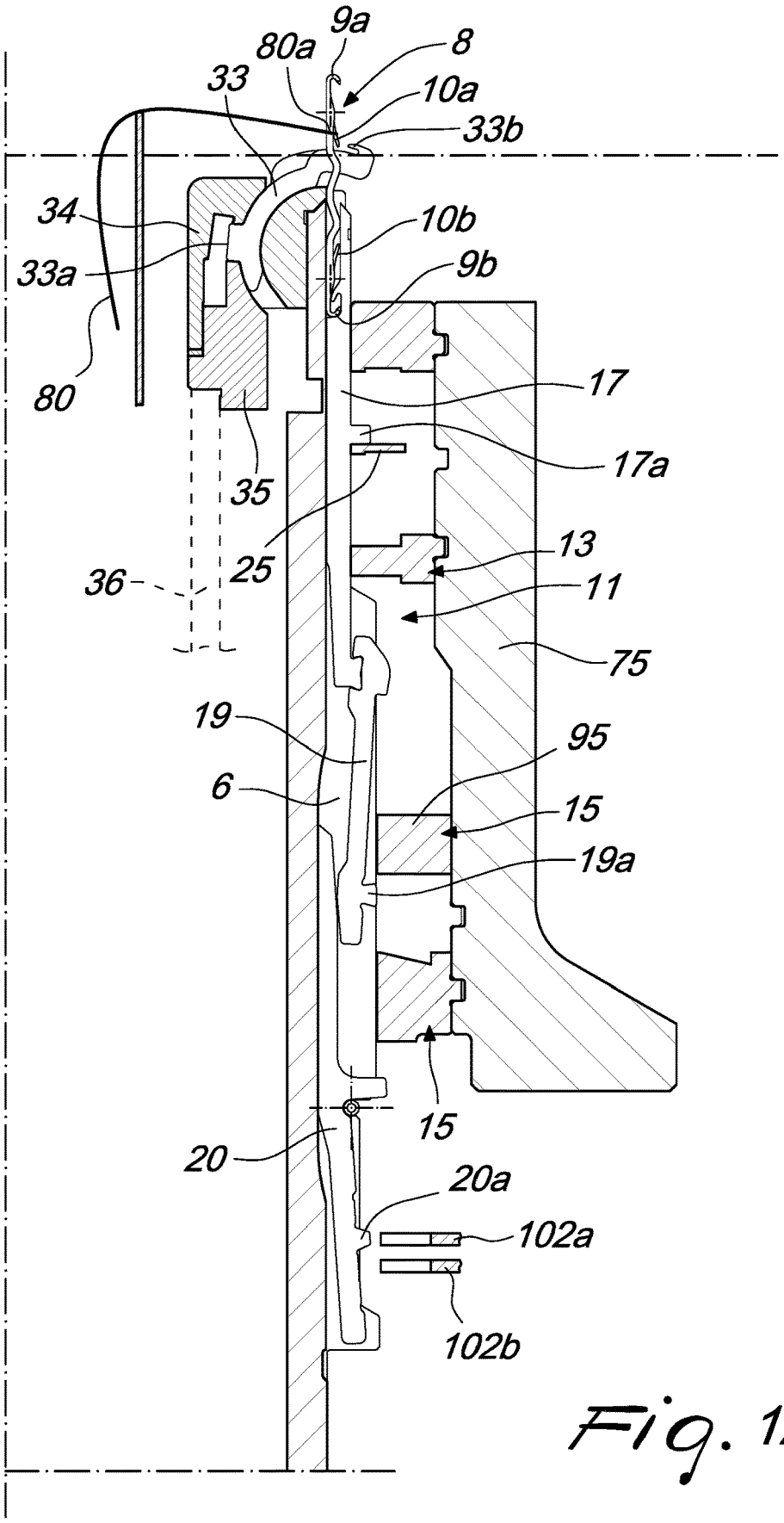
Figure 13:
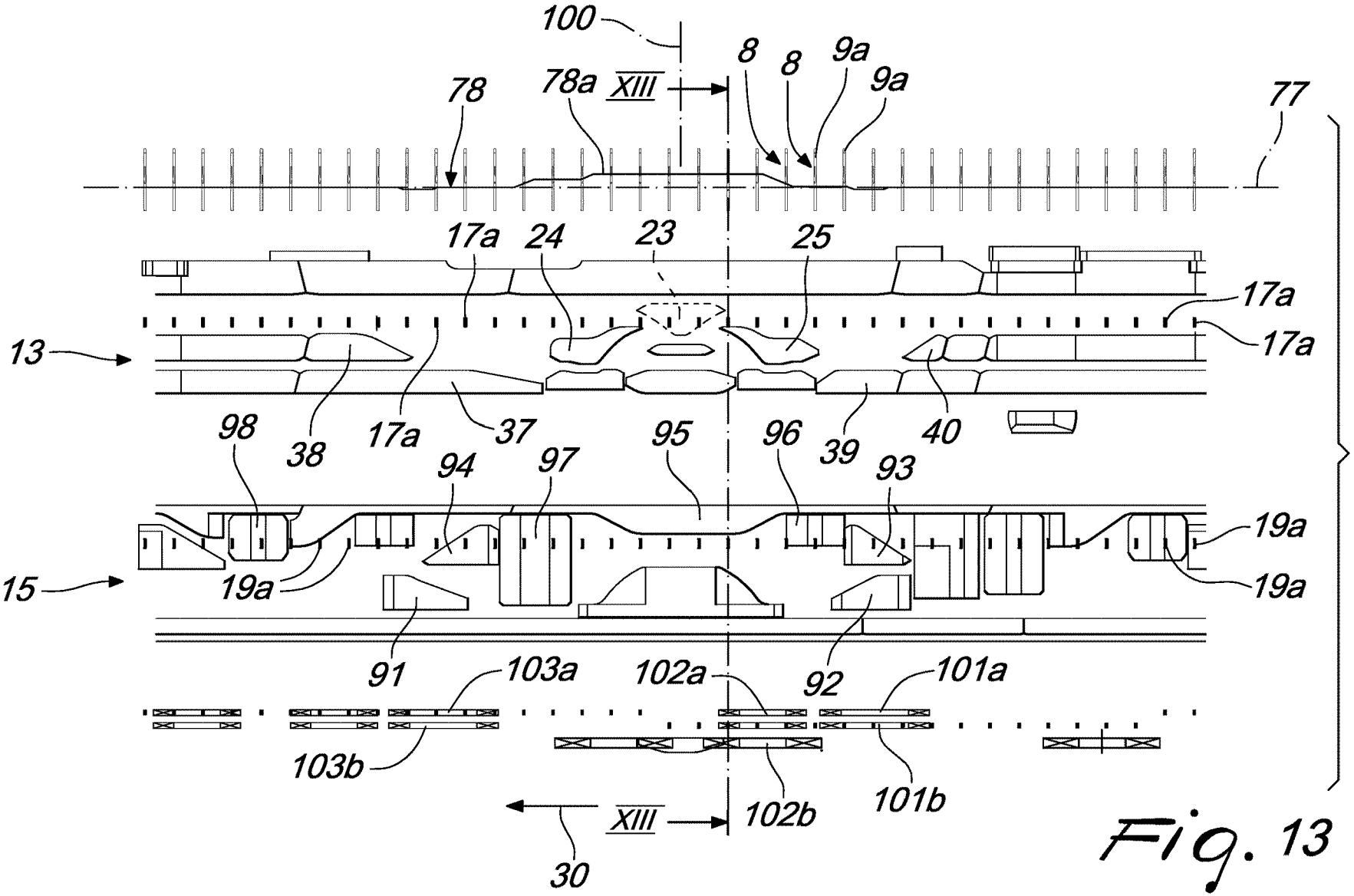
Figure 13A:
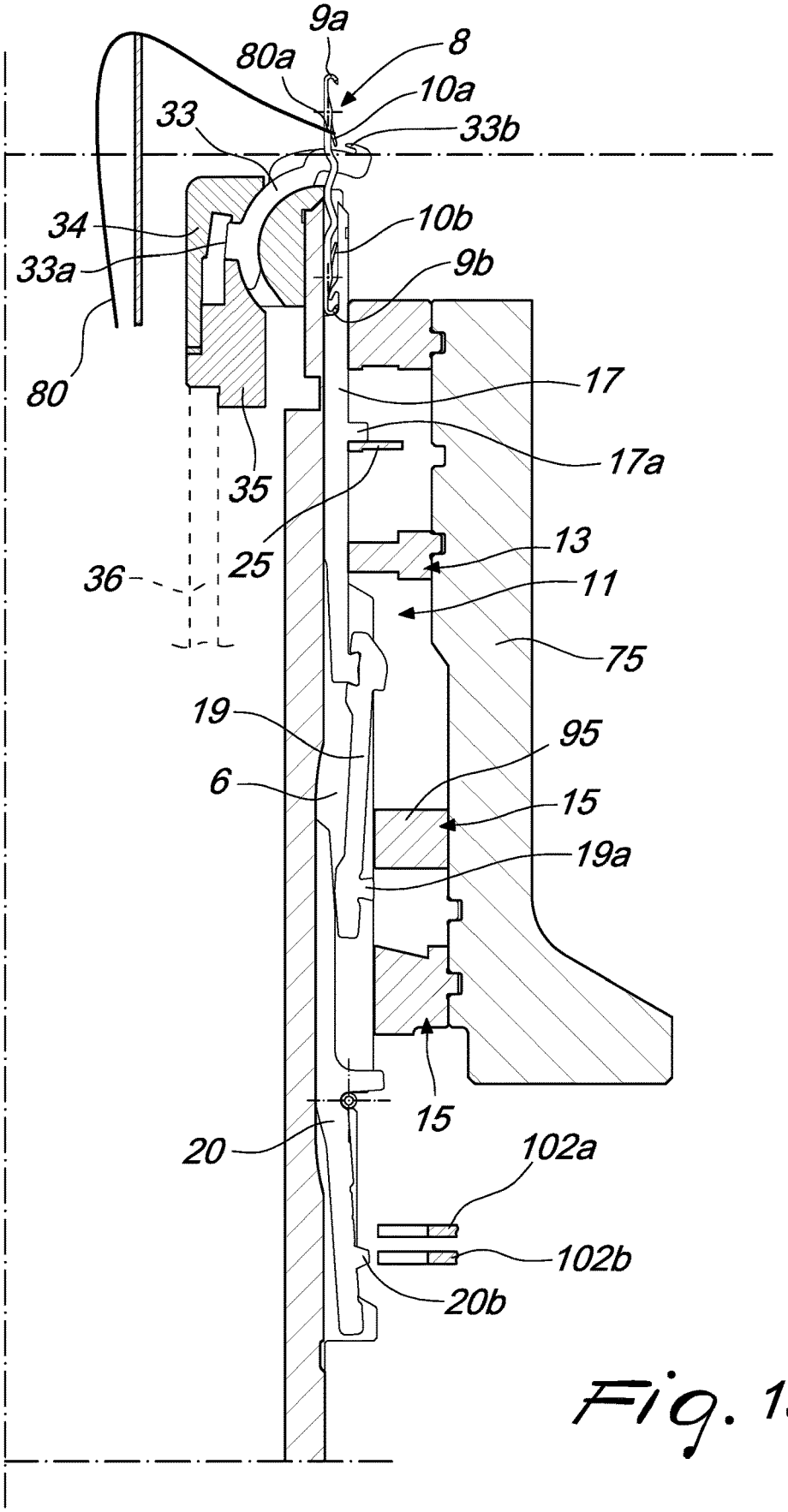
Figure 14:
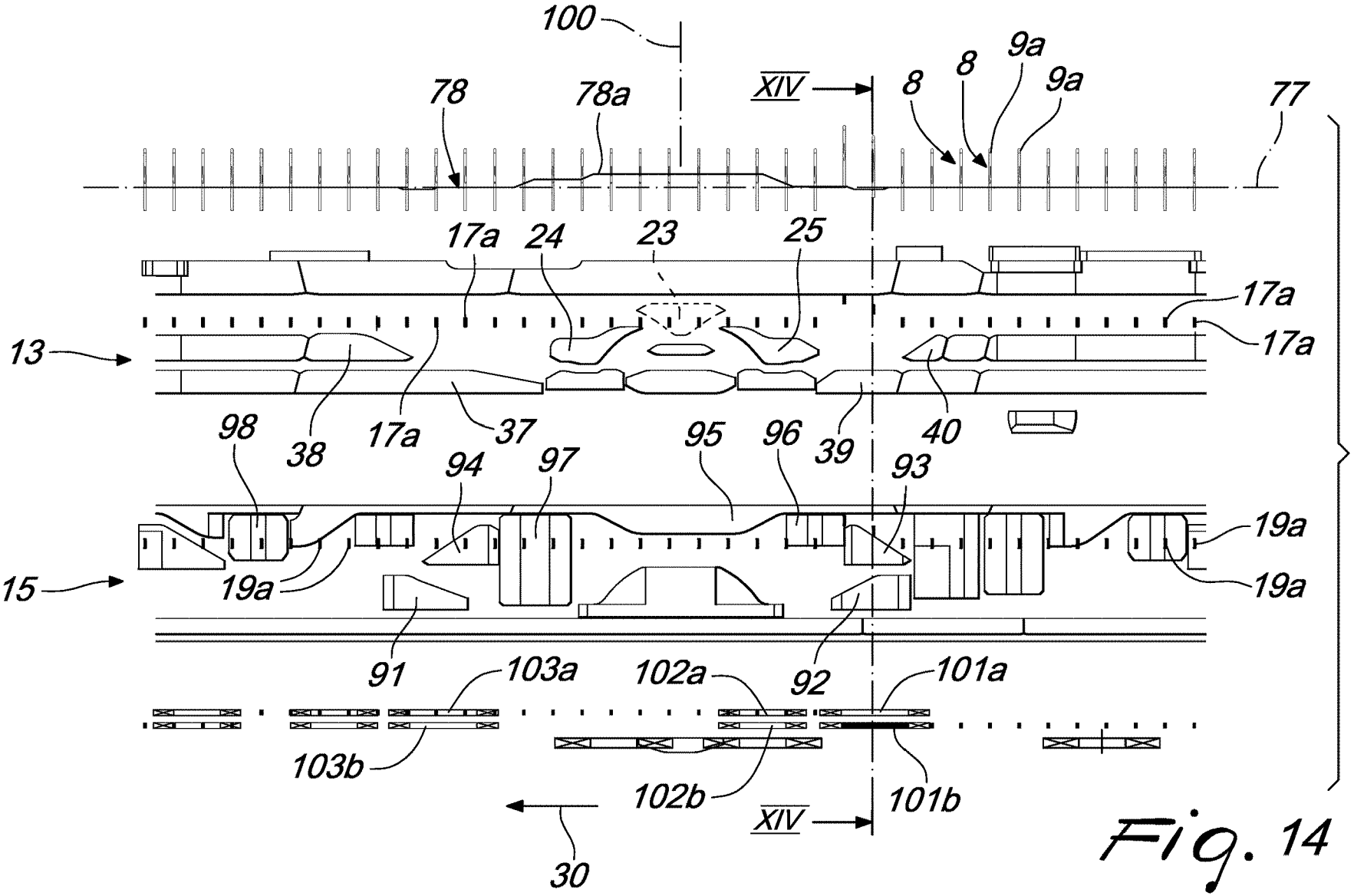
Figure 14A:
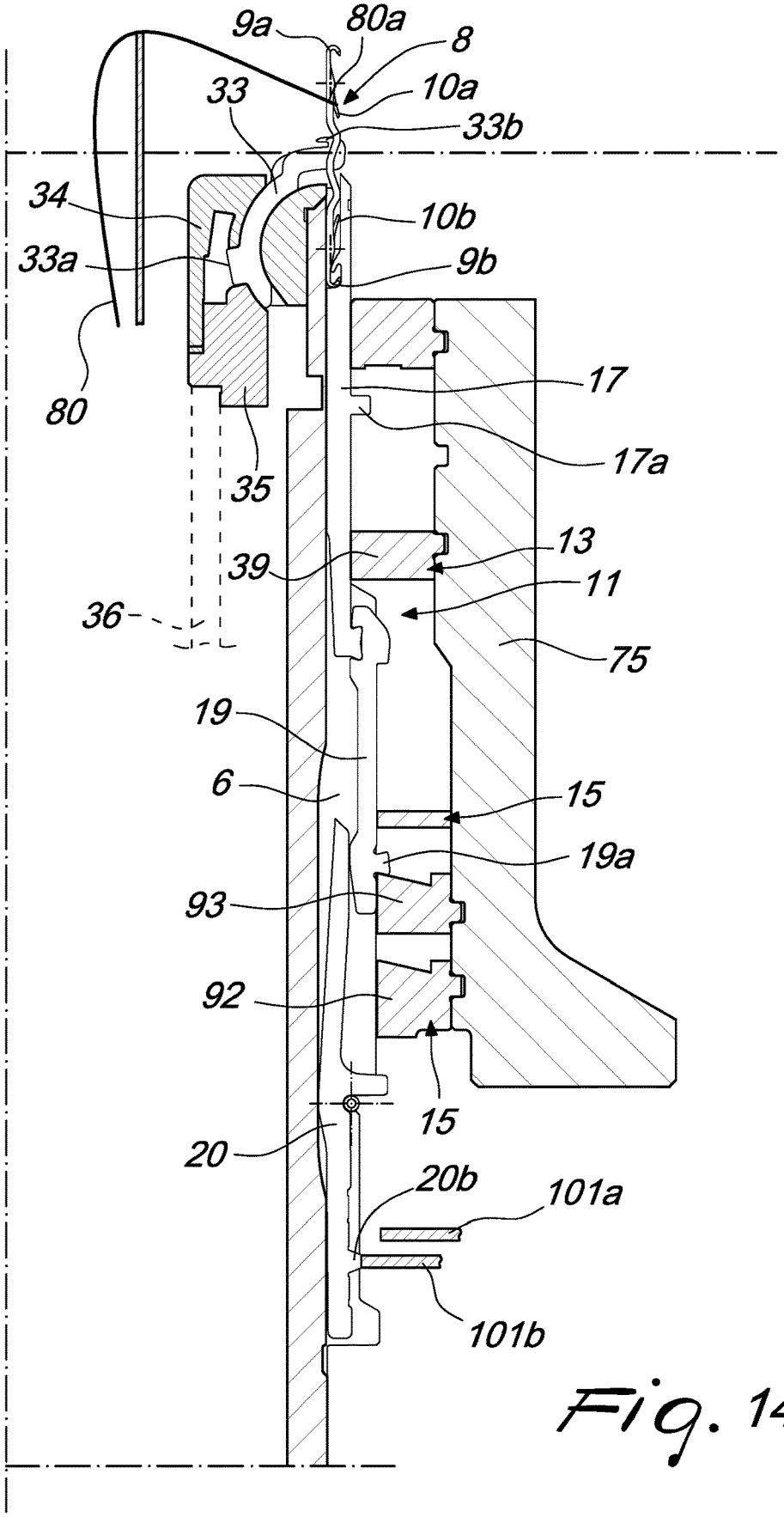
Figure 15:
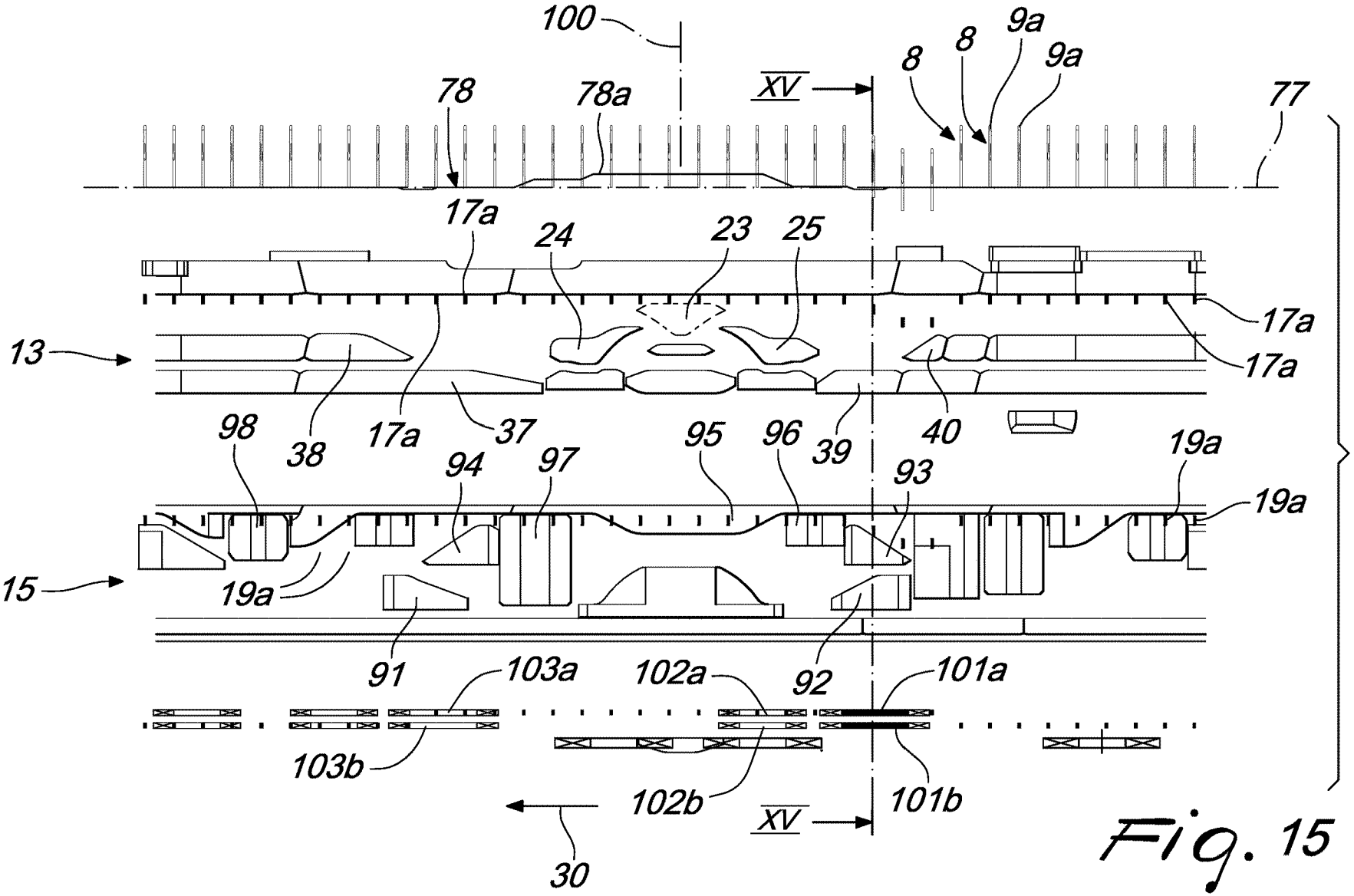
Figure 15A:
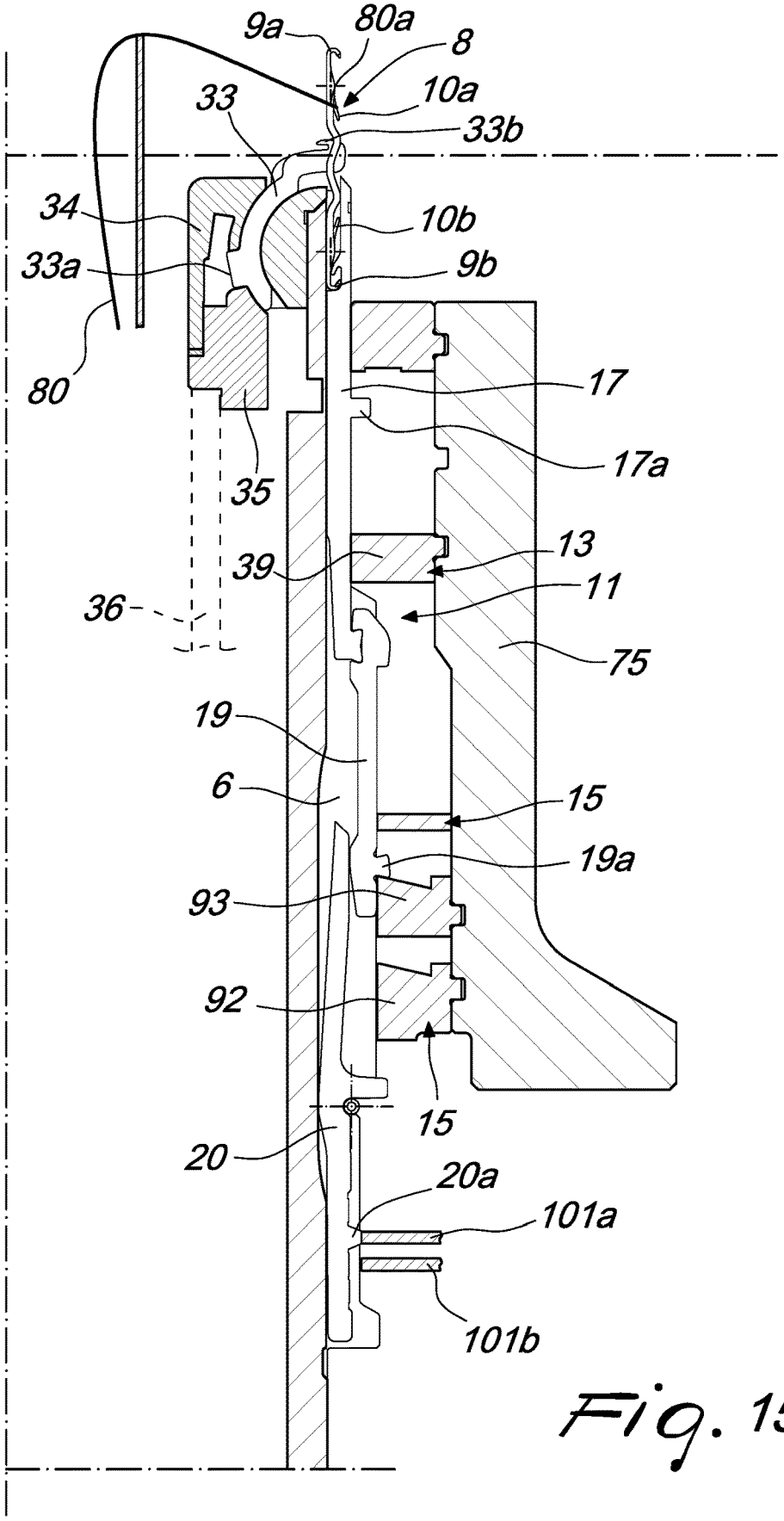
Figure 16:
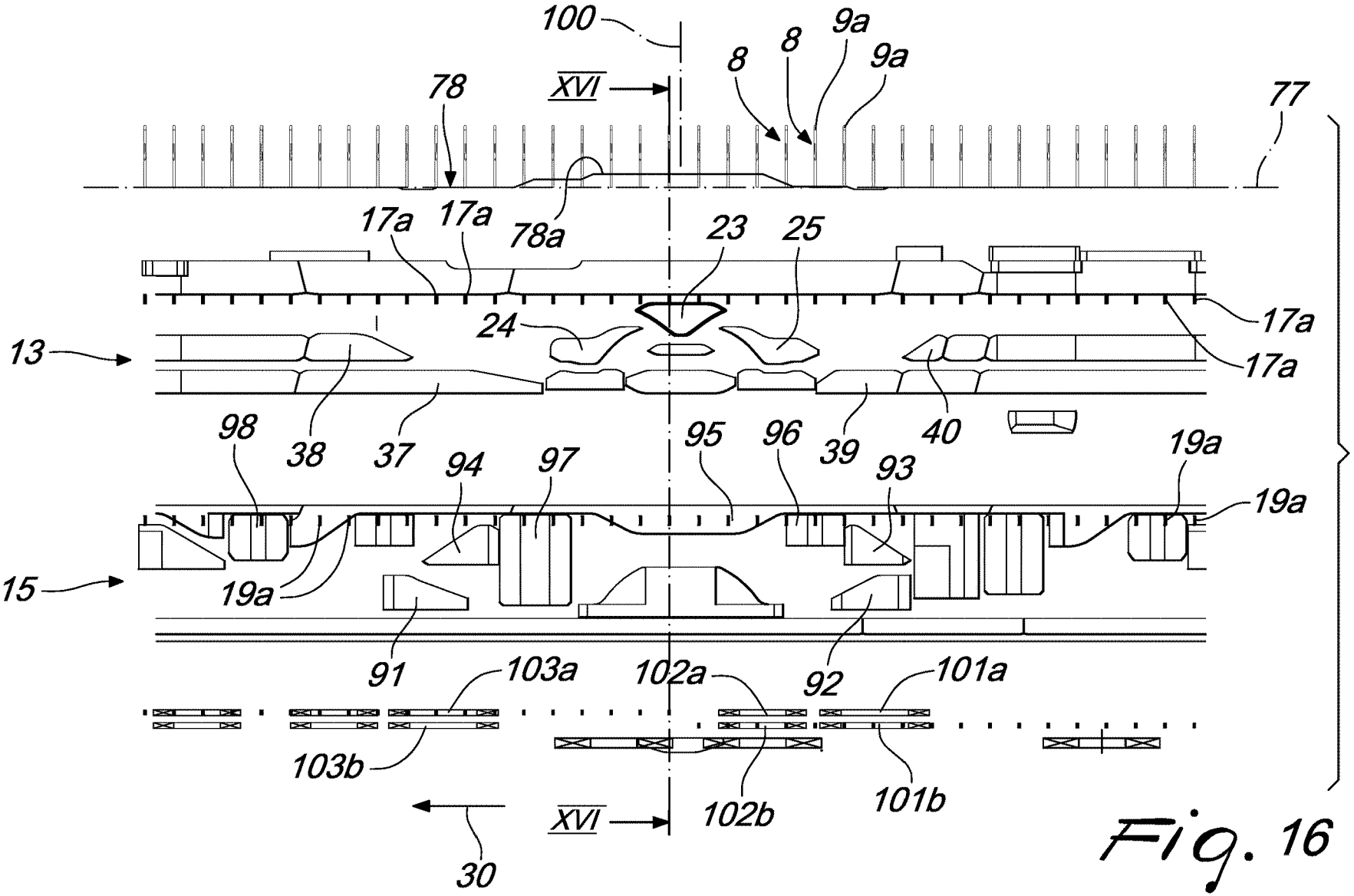
Figure 16A:
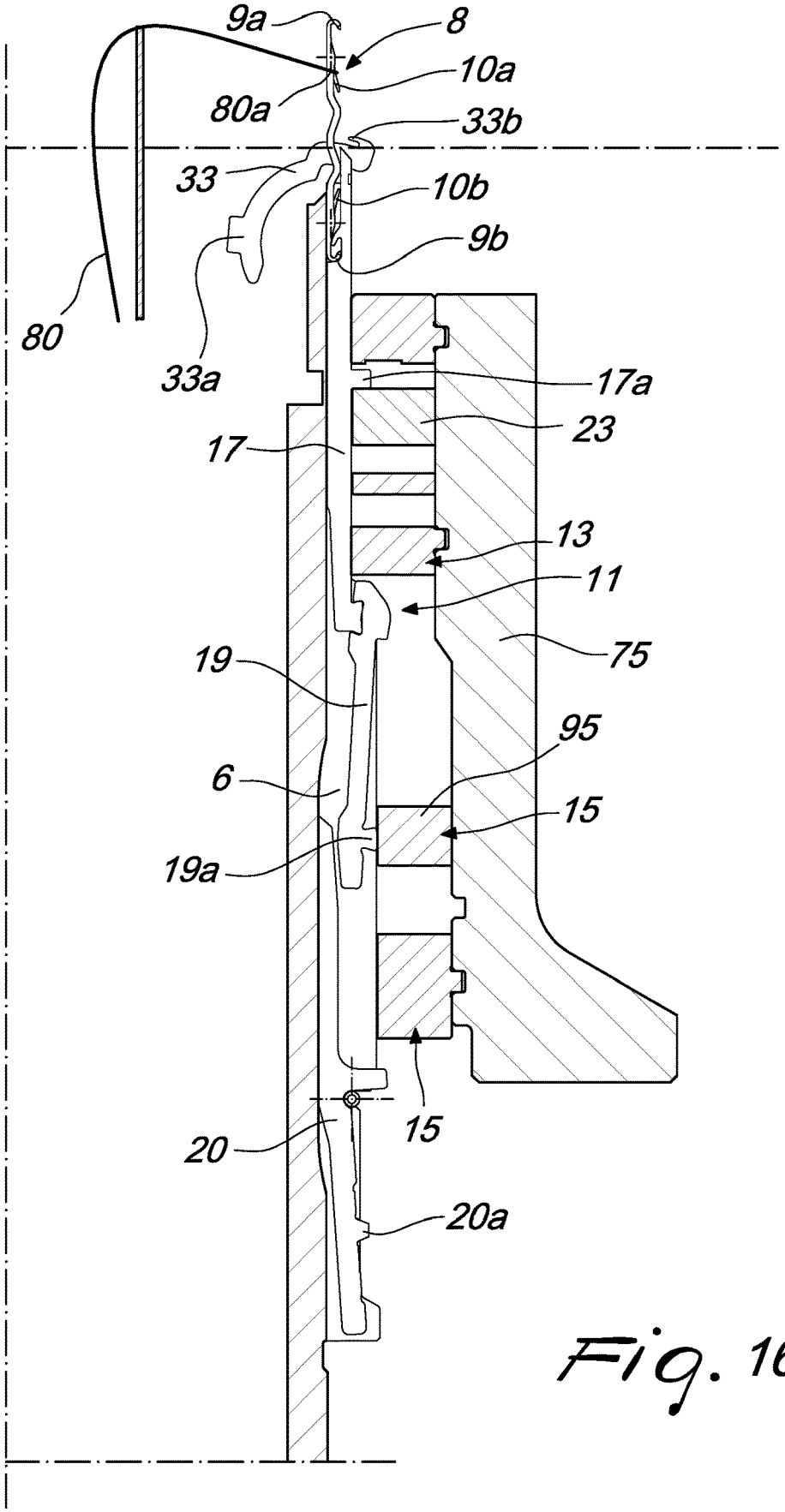

Figures from 6 and 6*a* to 16 and 16*a* schematically show the actuation of the machine during the execution of the method according to the invention with reference to a portion of the lower needle cylinder proximate to a feed or drop of the machine used to carry out the method, more specifically:

Figures from 6 to 16 show the complex of cams proximate to the feed or drop considered;

FIG. 6*a* schematically illustrates a portion of the upper end of the lower needle cylinder, in the active condition shown in FIG. 6, axially cross-sectioned along the plane VI-VI indicated in FIG. 6;

FIG. 7*a* schematically illustrates a portion of the upper end of the lower needle cylinder, in the active condition shown in FIG. 7, axially cross-sectioned along the plane VII-VII indicated in FIG. 7;

FIG. 8*a* schematically illustrates a portion of the upper end of the lower needle cylinder, in the active condition shown in FIG. 8, axially cross-sectioned along the plane VIII-VIII indicated in FIG. 8;

FIG. 9*a* schematically illustrates a portion of the upper end of the lower needle cylinder, in the active condition shown in FIG. 9, axially cross-sectioned along the plane IX-IX indicated in FIG. 9;

FIG. 10*a* schematically illustrates a portion of the upper end of the lower needle cylinder, in the active condition shown in FIG. 10, axially cross-sectioned along the plane X-X indicated in FIG. 10;

FIG. 11*a* schematically illustrates a portion of the upper end of the lower needle cylinder, in the active condition shown in FIG. 11, axially cross-sectioned along the plane XI-XI indicated in FIG. 11;

FIG. 12*a* schematically illustrates a portion of the upper end of the lower needle cylinder, in the active condition shown in FIG. 12, axially cross-sectioned along the plane XII-XII indicated in FIG. 12;

FIG. 13*a* schematically illustrates a portion of the upper end of the lower needle cylinder, in the active condition shown in FIG. 13, axially cross-sectioned along the plane XIII-XIII indicated in FIG. 13;

FIG. 14*a* schematically illustrates a portion of the upper end of the lower needle cylinder, in the active condition shown in FIG. 14, axially cross-sectioned along the plane XIV-XIV indicated in FIG. 14;

FIG. 15*a* schematically illustrates a portion of the upper end of the lower needle cylinder, in the active condition shown in FIG. 15, axially cross-sectioned along the plane XV-XV indicated in FIG. 15;

FIG. 16*a* schematically illustrates a portion of the upper end of the lower needle cylinder, in the active condition shown in FIG. 16, axially cross-sectioned along the plane XVI-XVI indicated in FIG. 16.

DETAILED DESCRIPTION OF THE INVENTION

With reference to Figures from 1 to 4, the machine for carrying out the method according to the invention, which is generally designated with the reference numeral 1, comprises a supporting structure 2 which is provided, in a manner known per se, with a footing 2*a* for resting on the ground and which supports, so that it can rotate about its own vertically oriented axis 3, a lower needle cylinder 4 and an upper needle cylinder 5, which is arranged above the lower needle cylinder 4 and which can be arranged coaxially to that lower needle cylinder 4.

On the lateral surface of the lower needle cylinder 4 and on the lateral surface of the upper needle cylinder 5, a plurality of axial grooves 6, 7 is defined in a way that is known per se. When the upper needle cylinder 5 is arranged above and coaxially to the lower needle cylinder 4, each one of the axial grooves 6 of the lower needle cylinder 4 is aligned with a corresponding axial groove 7 of the upper needle cylinder 5 and accommodates a needle 8 which can translate on command from the lower needle cylinder 4 to the upper needle cylinder 5 or conversely. The needle 8 is provided, in a way that is known per se, with an upper head 9*a*, which is hook-shaped, by way of which the needle 8 can pick up yarns and form knitting when the needle 8 is in the lower needle cylinder 4, and with a lower head 9*b*, which is hook-shaped, by way of which the needle 8 can pick up yarns and form knitting when the needle 8 is in the upper needle cylinder 5. Each head 9*a*, 9*b* of the needle 8 is provided with a latch 10*a*, 10*b* which is hinged to the shank of the needle 8 and which can move about its own pivoting axis with respect to the shank of the needle 8 in order to perform the opening or closing of the corresponding head 9*a*, 9*b*.

In each one of the axial grooves 6 of the lower needle cylinder 4, there is an element 11 for actuating the corresponding needle 8 when this is arranged in the lower needle cylinder 4. In a similar manner, in each one of the axial grooves 7 of the upper needle cylinder 5, there is an element 12 for actuating the corresponding needle 8 when this is arranged in the upper needle cylinder 5.

The actuation elements 11, 12 of the needles 8 are actuated by needle actuation cams which are arranged respectively about the upper needle cylinder 5 and about the lower needle cylinder 4 and which define paths that are engageable by heels of the elements 11, 12 for actuating the needles 8 in order to actuate the actuation elements 11, 12 which, in turn, actuate the needles 8. The actuation elements 11, 12 of the needles 8 comprise, in a way that is known per se, transfer sinkers 17, 18, also known as sliders.

More specifically, inside each axial groove of the lower needle cylinder 4, the actuation elements of the needles comprise a slider 17 which is provided, proximate to its upper end, with a hook for hooking the lower head 9*b* of the needle 8 and entraining the needle 8 in the lower needle cylinder 4 and also for actuating it with alternating motion along the corresponding axial groove 6 so that it takes the yarn or the yarns that are supplied at a feed or drop of the machine and forms knitting. The slider 17 is provided, along its extension, with at least one heel 17*a* which protrudes radially from the corresponding axial groove 6 and which engages with paths defined by actuation cams 13 of the sliders 17 which face toward the lateral surface of the lower needle cylinder 4 and which are connected to a lower cam support 75 which is arranged around the lower needle cylinder 4 and is fixed to the supporting structure 2 of the machine.

In a similar manner, in each axial groove 7 of the upper needle cylinder 5, there is a slider 18 which is provided, proximate to its lower end, directed toward the lower needle cylinder 4, with a hook for hooking the upper head 9*a* of the needle 8 and entraining it in the upper needle cylinder 5, and also for actuating that needle 8 along the axial groove 7 so that it takes the yarn or the yarns that are supplied at a feed or drop of the machine and forms knitting. The slider 18 is also provided, along its extension, with at least one heel 18*a* which protrudes radially from the corresponding axial groove 7 and which engages with paths defined by actuation cams 14 of the sliders 18 which face toward the lateral surface of the upper needle cylinder 5 and which are connected to an upper cam support 76 which is arranged around the upper needle cylinder 5 and is fixed to the supporting structure 2 of the machine.

In the embodiment shown, the actuation elements 11, 12 of the needles 8, at least with regard to the actuation elements 11 of the needles 8 arranged in the lower needle cylinder 4, are of the type illustrated in international patent application WO2007/113649 A1 of this same applicant. Each one of these actuation elements 11, in the lower needle cylinder 4, comprises a connecting element 19 which is provided, on its side directed toward the outside of the lower needle cylinder 4, with a movable heel 19*a*. The connecting element 19 can oscillate in a radial plane of the lower needle cylinder 4 in order to pass from an active position, in which its movable heel 19*a* protrudes radially from the corresponding axial groove 6 of the lower needle cylinder 4 in order to engage with corresponding actuation cams 15 of the connecting elements 19 which face toward the lateral surface of the lower needle cylinder 4 and define paths that can be travelled by this movable heel 19*a*, when the connecting element is in the active position, following the actuation of the lower needle cylinder 4 with a rotary motion about its own axis 3 with respect to the actuation cams 15 of the connecting elements 19, to an inactive position, in which the movable heel 19*a* is contained in the corresponding axial groove 6 of the lower needle cylinder 4 in order not to engage with the actuation cams 15 of the connecting elements 19, and vice versa.

The term "radial plane" is used to mean a plane of the sheaf of planes that passes through the axis 3 of the lower needle cylinder 4.

Each connecting element 19 is connected at the lower end of the slider 17 arranged in the same axial groove 6 of the lower needle cylinder 4.

Each actuation element 11 of the needles 8 comprises, furthermore, a selector 20 which has a portion thereof that projects between the connecting element 19 and the bottom of the axial groove 6 of the lower needle cylinder 4, in which it is accommodated, in any position that can be assumed by the connecting element 19 during the operation of the machine. The selector 20 can oscillate in a radial plane of the lower needle cylinder 4 in order to actuate the passage of the movable heel 19*a* of the connecting element 19 from the above mentioned inactive position to the above mentioned active position.

Each selector 20 is provided, proximate to its lower end, with a corresponding heel 20*a*, 20*b* which can be pressed in the direction of the bottom of the axial groove 6 in which it is accommodated, by way of actuation levers 101*a*, 101*b*, 102*a*, 102*b*, 103*a*, 103*b*, which are laterally facing toward the lower needle cylinder 4 and which will be better described below.

The heels 17*a* of the sliders 17 arranged in the lower needle cylinder 4, differently from what happens in conventional machines in which one half of the lower needle cylinder is occupied by short-heel sliders while the other half is occupied by long-heel sliders, all have the same length.

In the machine for carrying out the method according to the invention, in order to execute knitting work that requires a diversification of actuation for the needles 8 situated in the two halves of the lower needle cylinder 4, the selectors 20 arranged in one half of the lower needle cylinder 4 are provided with a heel 20*a*, while the selectors 20 arranged in the other half of the lower needle cylinder 4 are provided with a heel 20*b* which is offset in height with respect to the heel 20*a* and the actuation levers 101*a*, 101*b*, 102*a*, 102*b*, 103*a*, 103*b* are arranged at two height levels so as to be able to act on one or the other of these heels 20*a* and 20*b*, as will be better described below.

Figure 5:
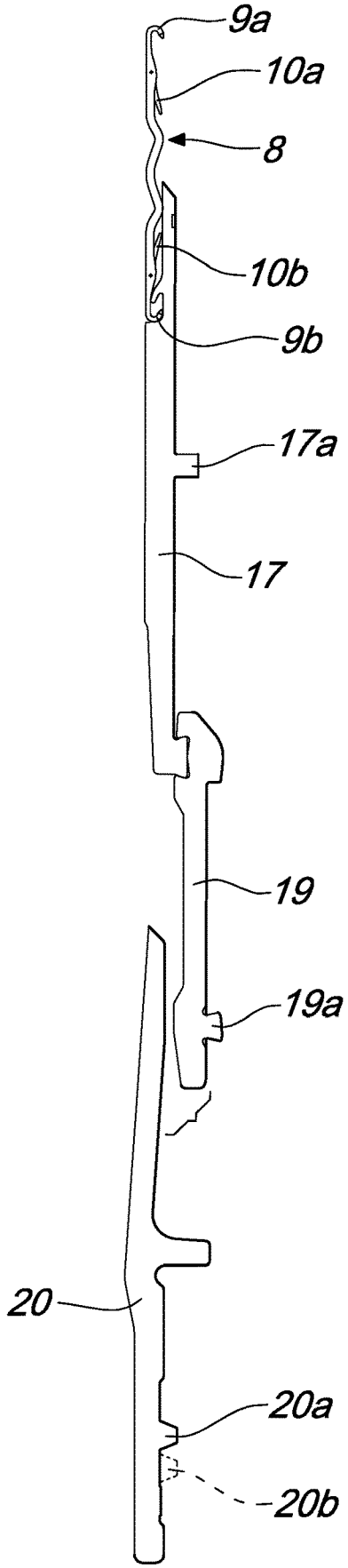
FIG. 5 shows the complex of elements that constitutes the actuation element of each needle and the corresponding needle which are accommodated in a same axial groove of the lower needle cylinder.

The different deployment of the heels 20*a* and 20*b* is shown in FIG. 5 in which a selector 20 is shown with its heel 20*a* and a dotted line shows the position of the heel 20*b* of a selector 20 accommodated in the other half of the lower needle cylinder 4.

Figure 1:
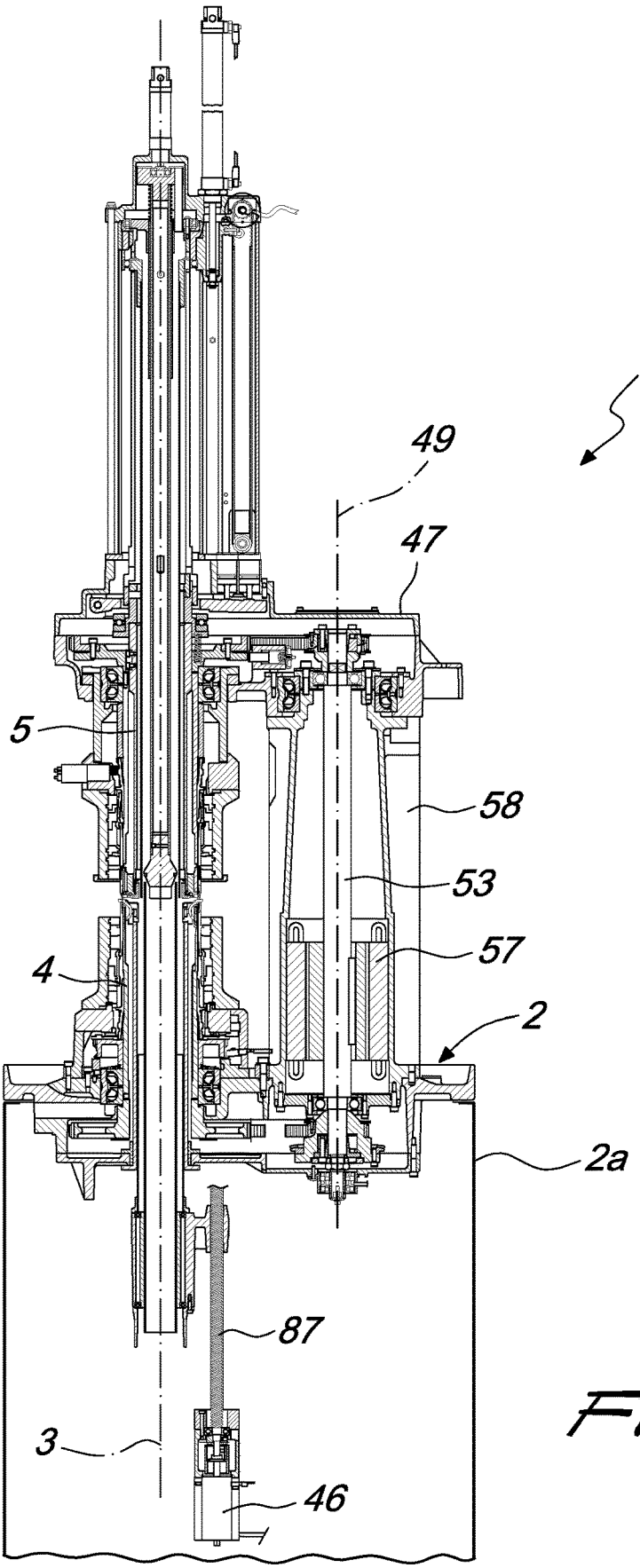
FIG. 1 schematically illustrates the machine for executing the method according to the invention, in a cross-sectional view taken along a vertical plane that passes through the axis of the lower needle cylinder and through the axis of the upper needle cylinder arranged above and coaxially to the lower needle cylinder.
Figure 2:
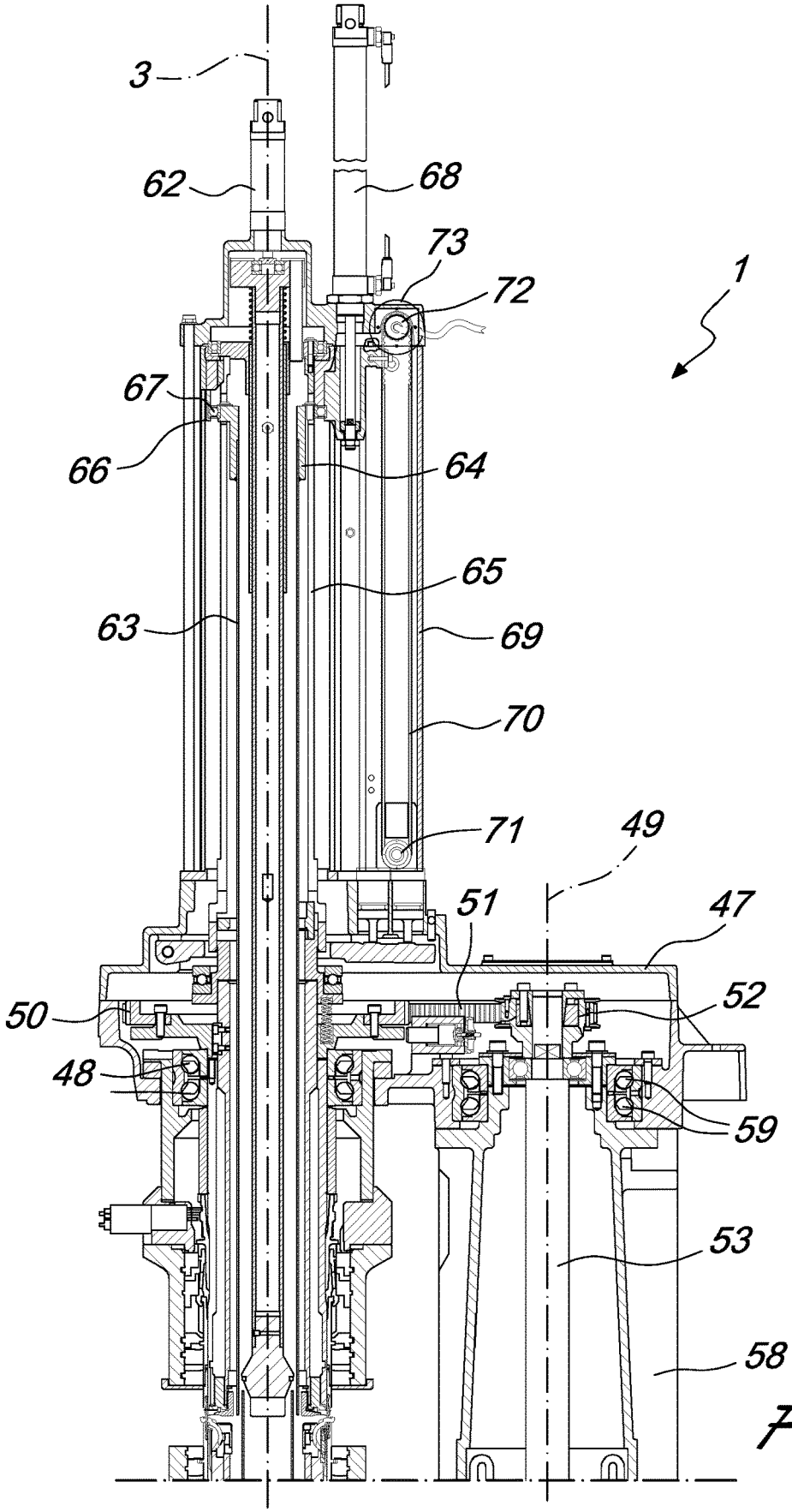
FIG. 2 is an enlarged detail of FIG. 1.
Figure 3:
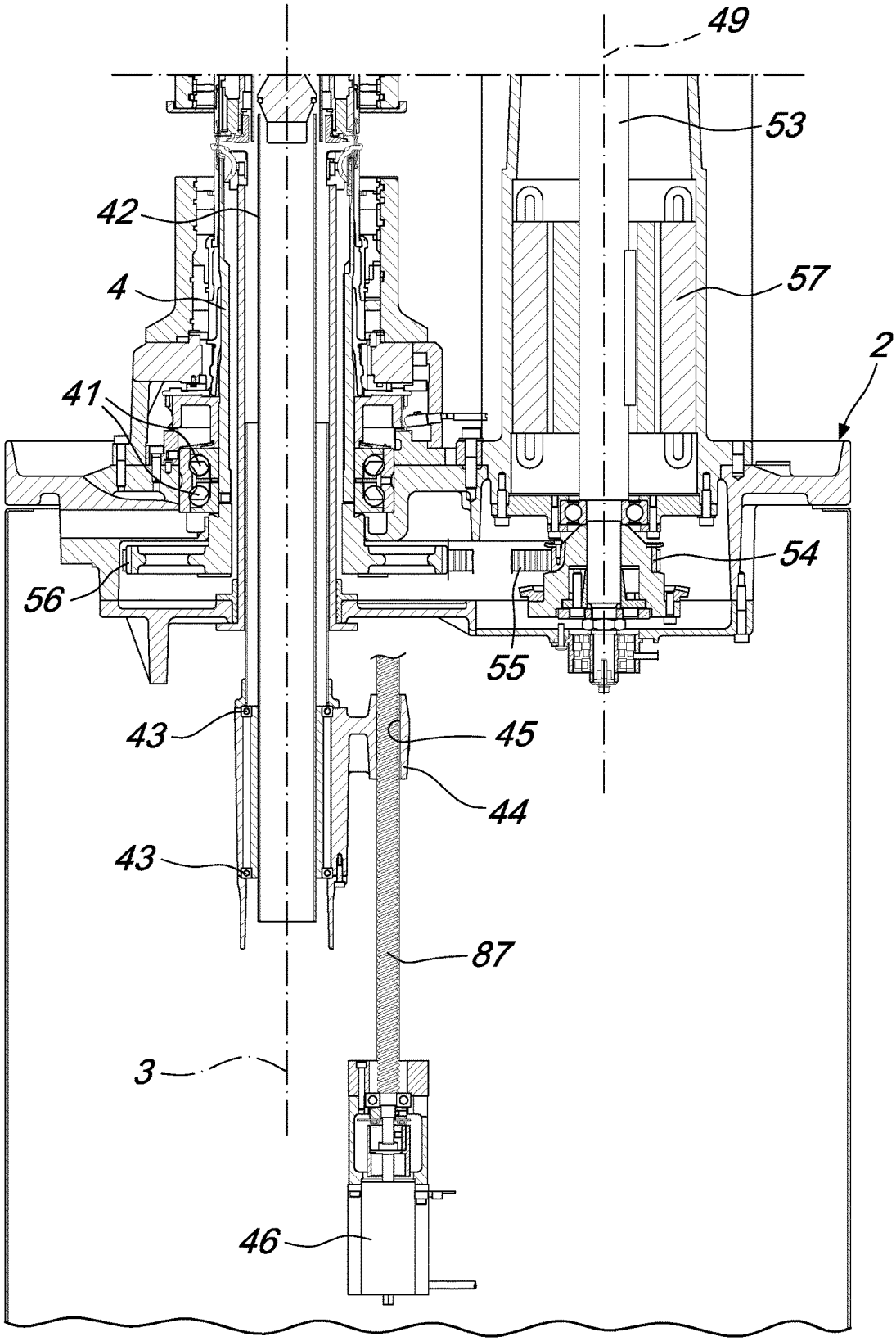
FIG. 3 is another enlarged detail of FIG. 1.
Figure 4:
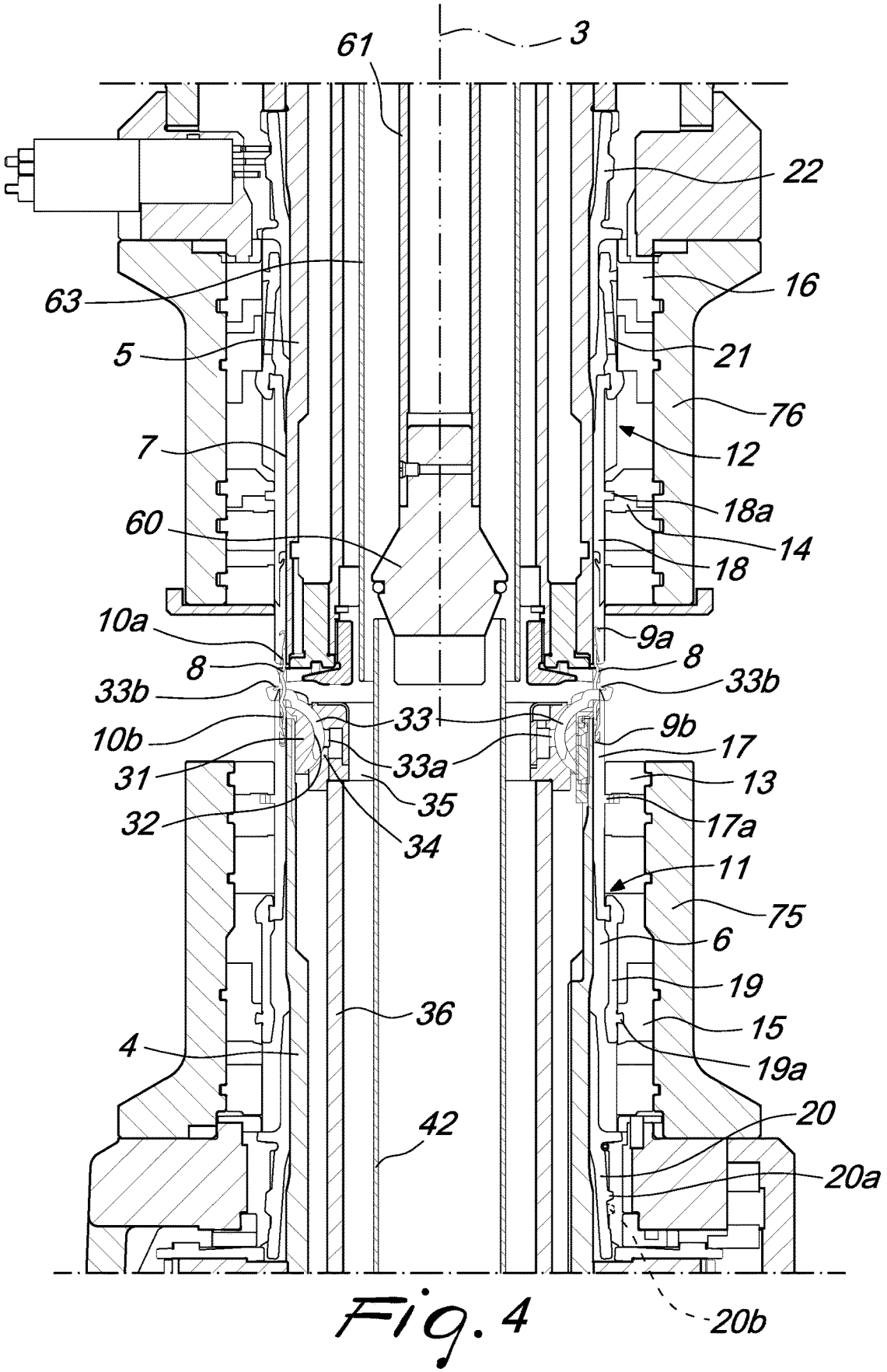
FIG. 4 is a detail of FIG. 1, enlarged further.

The elements 12 for actuating the needles 8 arranged in the upper needle cylinder 5 can be provided and actuated, as shown in Figures from 1 to 4, similarly to the actuation elements 11 of the needles 8 arranged in the lower needle cylinder 4. In FIG. 4, the connecting elements arranged in the upper needle cylinder 5 have been designated with the reference numeral 21, the corresponding actuation cams with the reference numeral 16 and the selectors with the reference numeral 22.

For better comprehension of the actuation elements 11, 12 of the needles 8 and of their operation, please see international patent application WO2007/113649 A1, which should be understood as being included herein as a reference.

Arranged inside the lower needle cylinder 4, proximate to its upper end, is an annulus of the sinkers 31, in which a plurality of arc-like grooves 32 is defined, each of which is arranged between two contiguous axial grooves 6. Accommodated inside each one of these arc-like grooves 32 is a knockover sinker 33, also referred to hereinbelow as "sinker" for the sake of simplicity, which has, at an upper end thereof, a beak 33*b* which, by way of the sliding of the knockover sinkers 33 inside the corresponding arc-like groove 32, can move toward or away from the axis 3 of the lower needle cylinder 4. More specifically, the beak 33*b* of each sinker 33 is positioned at the upper end of the axial grooves 6 defined in the lateral surface of the lower needle cylinder 4 and is directed toward the axis 3 of the lower needle cylinder 4. Each sinker 33 has, in an intermediate region of its extension, a heel 33*a* which protrudes from the corresponding arc-like groove 32 and which engages within a path defined by actuation cams 34 of the sinkers 33 which are fixed to an annular supporting element 35 which is arranged inside and coaxially to the lower needle cylinder 4 proximate to the upper end thereof.

The path defined by these actuation cams 34 of the sinkers 33 is contoured so as to cause an alternating motion of the sinkers 33 along the corresponding arc-like grooves 32 following the rotation movement of the sinkers 33, integrally with the lower needle cylinder 4 about its own axis 3 with respect to the supporting structure 2 of the machine. In particular, this contoured path is such as to cause, during the forming of the article 80, a distancing of the beak 33*b* of the sinkers 33 from the axis 3 of the lower needle cylinder 4 at each feed or drop of the machine and that is to say at the set of knitting forming cams 23, 24, 25, and an approach of the beak 33*b* of the sinkers 33 toward the axis 3 of the lower needle cylinder 4 in the remaining part of the rotation of the lower needle cylinder 4 about its own axis 3.

By way of the alternating movement of each sinker 33 inside the corresponding arc-like groove 32, during the forming of the article 80, the beak 33*b* of each sinker 33 moves toward the axis 3 of the lower needle cylinder 4, engaging with the area of knitting located between two contiguous needles 8 and performing the tensioning of the loops of knitting formed by these needles 8 against the shank of these same needles 8 while these are lifted to the drop stitch position in order to pick up the yarn supplied to a feed of the machine. In the drop stitch position, the needle 8 is lifted to a level such that the previously-formed loop of knitting, which is held by the sinkers 33 against the shank of the needle, is below the upper latch 10*a* of the needle 8. Subsequently, the beak 33*b* of the sinker 33 moves away from the axis 3 of the lower needle cylinder 4 while these needles 8 descend inside the corresponding axial groove of the lower needle cylinder 4, forming new loops of knitting and knocking over, i.e. abandoning, the previously-formed loops of knitting which in this way are knitted with the new loops of knitting.

The supporting element 35 is fixed to the upper end of a head tube 36 which is accommodated inside and coaxially to the lower needle cylinder 4. Such head tube 36 is connected, in a way that is known per se, to the supporting structure 2 of the machine with the ability to rotate about the axis 3 with respect to the lower needle cylinder 4 according to angles of preset breadth in order to anticipate or retard the intervention of the actuation cams 34 of the sinkers 33 on the sinkers 33, according to processing requirements.

The lower needle cylinder 4 is supported by the supporting structure 2 so that it can rotate about its own vertically oriented axis 3, by way of a pair of bearings 41.

Arranged inside and coaxially to the lower needle cylinder 4 is a suck and blow tube 42 which is integral with the lower needle cylinder 4 in rotation about its own axis 3. The suck and blow tube 42 can be connected to a suction conduit, not shown for the sake of simplicity, and is adapted to receive the article 80, starting from its opposite axial end with respect to the axial end engaged with the needles 8.

The suck and blow tube 42 exits, with its lower end, from the lower end of the lower needle cylinder 4 and, at its lower end portion arranged externally to the lower needle cylinder 4, it is supported, so that it can rotate about its own axis, by way of the interposition of a pair of bearings 43, by a block 44. This block 44 is coupled, by way of a coupling of the leadscrew 45 type, with a threaded shank 87 which is oriented parallel to the axis 3 of the lower needle cylinder 4 and which is fixed to the output shaft of an electric motor 46, for example a stepped motor.

In this manner, actuating the electric motor 46 causes the movement of the suck and blow tube 42 along the axis 3 of the lower needle cylinder 4, with respect to that lower needle cylinder 4.

The length of the suck and blow tube 42 in relation to the length of the lower needle cylinder 4 is such that the upper end of the suck and blow tube 42 is arranged proximate to the upper end of the lower needle cylinder 4 and that is to say proximate to the work area of the needles 8 of the machine. By way of the axial movement of the suck and blow tube 42 with respect to the lower needle cylinder 4, it is possible to bring the upper end of the suck and blow tube 42 completely inside the lower needle cylinder 4 or to bring the end upper of the suck and blow tube 42 to protrude above from the upper end of the lower needle cylinder 4 in order to push the article 80 upward, as will be explained in more detail below.

The upper needle cylinder 5 is supported, so that it can rotate about its own vertically oriented axis, by an arm 47 by way of a pair of bearings 48. The arm 47 is, in turn, supported, by way of a pair of bearings 59, so that it can rotate about an axis 49 which is parallel to and spaced apart from the axis 3 of the lower needle cylinder 4, by a column 58 which is fixed to the supporting structure 2. The arm 47 can rotate on command about such axis 49 so as to make it possible to bring the upper needle cylinder 5 above and coaxially to the lower needle cylinder 4 or in a position that is laterally spaced apart from the lower needle cylinder 4. The upper needle cylinder 5 is kinematically connected to the lower needle cylinder 4 by way of a first toothed pulley 50 which is fixed coaxially to the upper needle cylinder 5 and which is connected, by way of a first toothed belt 51, to a second toothed pulley 52 which is keyed to the upper end of a connecting shaft 53 which is arranged parallel to the axis 3 of the lower needle cylinder 4. At the lower end of the connecting shaft 53, a third toothed pulley 54 is keyed and is connected, through a second toothed belt 55, to a fourth toothed pulley 56 fixed coaxially to the lower needle cylinder 4.

Preferably, the connecting shaft 53 constitutes the shaft of the main electric motor 57 of the machine which is arranged laterally to the lower needle cylinder 4 inside the column 58 which, through the arm 47, supports the upper needle cylinder 5, as described in international patent application WO2012/072296 A1 of this same applicant.

Arranged inside the upper needle cylinder 5, proximate to the lower end of this, is an element 60 for locking the article 80 which is engageable with the upper end of the suck and blow tube 42. This locking element 60 is shaped like a plug and is fixed at the lower end of a shank 61 which is arranged inside and coaxially to the upper needle cylinder 5 and which is connected, with its upper end, to the shank of the piston of a fluid-operated actuation cylinder 62 connected to the upper end of the upper needle cylinder 5. By way of the actuation of this fluid-operated actuation cylinder 62, when the upper needle cylinder 5 is arranged above and coaxially to the lower needle cylinder 4, the movement is caused of the shank 61 and therefore of the locking element 60 along the axis 3 of the lower needle cylinder 4, causing its engagement with the upper end of the suck and blow tube 42 or its disengagement from the upper end of that suck and blow tube 42.

Arranged inside and coaxially to the upper needle cylinder 5, around the shank 61 and around the locking element 60, is a tensioning tube 63 which is fixed, with its upper end, to an inner sleeve 64 which is slideable partially within a guiding tube 65 arranged coaxially to the upper needle cylinder 5 and fixed integrally to the upper end of that upper needle cylinder 5. The inner sleeve 64 is connected, passing through at least one axial groove that passes through the lateral surface of the guiding tube 65, to an outer sleeve 66 with the interposition of a bearing 67 so that the inner sleeve 64, together with the tensioning tube 63, can rotate integrally with the upper needle cylinder 5 while the outer sleeve 66 is not affected by this rotation. The outer sleeve 66 is connected to the shank of the piston of a fluid-operated actuation cylinder 68 which is fixed with its body to a supporting element 69 fixed to the arm 47 that supports the upper needle cylinder 5. Actuation of the fluid-operated actuation cylinder 68 causes the sliding, along the axis of the upper needle cylinder 5, of the outer sleeve 66, of the inner sleeve 64 and of the tensioning tube 63. The shank of the fluid-operated actuation cylinder 68 is furthermore connected to a toothed belt 70 which connects two toothed pulleys 71, 72 on parallel horizontal axes to each other. The pulley 72 is connected to an encoder 73 by way of which it is possible to detect constantly, and with high precision, the movement of the tensioning tube 63 along the axis of the upper needle cylinder 5.

In practice, at the start of the forming of the article 80, the axial end of the article 80 produced first is sucked into the upper end of the suck and blow tube 42 and is locked with respect to that suck and blow tube 42 by the engagement of the locking element 60 against the upper end of that suck and blow tube 42. During the forming of the article 80, the tensioning tube 63 is progressively lowered so as to engage, with its lower end, with the portion of the article 80 that extends from the upper end of the suck and blow tube 42 to the needles 8 of the machine that are forming it. The lowering of the tensioning tube 63 ensures the tensioning of the article 80 during its formation and this tensioning can be controlled through the detection of the lowering of the tensioning tube 63 which is done by way of the encoder 73.

Described below, with reference to Figures from 6 to 16, are the needle actuation cams, which are constituted by the actuation cams 13 of the sliders 17 and by the actuation cams 15 of the connecting elements 19, with particular regard to the actuation cams which are used to carry out the method according to the invention. Such figures show a portion of the machine corresponding to the lower needle cylinder 4, showing the actuation cams 15 of the connecting elements 19 and the actuation cams 13 of the sliders 17 arranged in the axial grooves 6 of the lower needle cylinder 4. The complex of the cams has been developed on a plane and their representation has been limited to an area of the machine proximate to a feed or drop which is used to execute the preparation of the article 80 in view of its removal from the machine at the end of the production cycle.

Figures from 6 to 16 show, indicatively, the path 78 defined by the actuation cams 34 of the sinkers 33, and the portion of this path, which causes the distancing of the beak 33*b* of the sinkers 33 from the axis 3 of the lower needle cylinder 4, has been designated with the reference numeral 78*a*.

Such figures show some heels 17*a* of the sliders 17, some heels 19*a* of the connecting elements 19 and some heels 20*a*, 20*b* of the selectors 20 in order to show their path following the engagement or otherwise with the corresponding actuation cams and actuation levers.

The needles 8, following their actuation by the needle actuation cams, in carrying out the method according to the invention, can assume the following positions:

drop stitch position;
tuck stitch position;
floated stitch position;
intermediate position.

The term "drop stitch position" is used to mean the position in which the needle 8 is arranged with its upper latch 10*a* above the knitting forming plane or knockover plane, designated in Figures from 6 to 16 with the reference numeral 77, which is the plane defined by the sinkers 33 on which the yarn picked up by the needles 8 rests while these are lowered in the lower needle cylinder 4 in order to form new loops of knitting. When the needle 8 reaches this position, it is with its upper head 9*a* at a level that is such as to pick up the yarn or the yarns that are dispensed at a feed or drop of the machine. In this position of the needle 8, if the sinkers 33 were engaged with the article 80 as occurs during the production of the article 80, the last loop of knitting formed descends on the shank of the needle 8 below the upper latch 10*a* of the needle 8.

The term "tuck stitch position" is used to mean the position in which the needle 8 is lifted, but to a lesser extent with respect to the drop stitch position. In the tuck stitch position, the free end of the upper latch 10*a*, completely open, is arranged below the knitting forming plane or knockover plane 77. When the needle 8 reaches this position, it is with its upper head 9*a* at a level that is such as to be able to pick up the yarn or the yarns that are dispensed at a feed or drop of the machine, but the last loop of knitting formed does not descend below the upper latch 10*a* of the needle 8.

The term "floated stitch position" is used to mean the position in which the needle 8 is lowered with its upper head 9*a* below the knitting forming plane or knockover plane 77.

The term "intermediate position" is used to mean a position in which the needle 8 is lifted to a greater extent with respect to the tuck stitch position but to a lesser extent with respect to the drop stitch position. In the intermediate position, the latch of the needle 8, completely open, is arranged with its lower end above the knitting forming plane or knockover plane 77.

Figures from 6 to 16 also show a portion, starting from their upper head 9*a*, of some needles 8 engaged by the sliders 17 of which the heels 17*a* are shown in order to highlight their position with respect to the knitting forming plane or knockover plane 77.

As shown in Figures from 6 to 16, the actuation cams 13 of the sliders 17 arranged in the lower needle cylinder 4 comprise a set of cams called "knitting forming cams" which is arranged at a feed or drop of the machine, schematically indicated by the line 100. This set of cams comprises, as in conventional machines: a central cam 23, with the typical triangle shape and arranged at the feed or drop 100, a first knockover cam 24 which operates when the lower needle cylinder 4 rotates in one direction, the outbound direction, designated by the arrow 30 in Figures from 6 to 16, a second knockover cam 25, which is arranged substantially symmetrically to the first transfer cam 24 with respect to a central plane that passes through the axis 3 of the lower needle cylinder 4 i.e. with respect to the central cam 23 and which operates when the lower needle cylinder 4 rotates in the opposite direction, the return direction.

The actuation cams 13 of the sliders 17 also comprise a first cam for holding in the floated stitch position 37 and a first cam for completion of the lifting to the tuck stitch position 38, which are arranged downstream of the first knockover cam 24 according to the direction of rotation designated by the arrow 30. Correspondingly, downstream of the second knockover cam 25 according to the opposite direction of rotation to the direction of rotation 30, there is a second cam for holding in the floated stitch position 39 and a second cam for completion of the lifting to the tuck stitch position 40. Defined between these cams 37, 39 and 38, 40 is a channel in which the heel 17*a* of the sliders is inserted when the corresponding needle has to be held in the floated stitch position.

The actuation cams 13 of the sliders 17 comprise other cams which are not described in detail because they do not play an active part in the operation of the machine during the execution of the method according to the invention.

The actuation cams 15 of the connecting elements 19 comprise a first cam for lifting to the tuck stitch position 91, which is arranged directly upstream of the first cam for completion of the lifting to the tuck stitch position 38, according to the direction of rotation 30, and a second cam for lifting to the tuck stitch position 92 which is arranged directly upstream of the second cam for completion of the lifting to the tuck stitch position 40, according to the opposite direction of rotation with respect to the direction of rotation 30.

The actuation cams 15 of the connecting elements 19 also comprise a first cam for lifting to the drop stitch position 93, which is arranged upstream of the second knockover cam 25 according to the direction of rotation 30, and a second cam for lifting to the drop stitch position 94, which is arranged upstream of the first knockover cam 24 according to the opposite direction of rotation with respect to the direction of rotation 30.

The actuation cams 15 of the connecting elements 19 comprise, furthermore, a lowering cam 95 which is arranged directly upstream of the central cam 23 according to the direction of rotation 30.

The actuation cams 15 of the connecting elements 19 also comprise pressers which are engageable with the connecting elements 19 so as to cause their oscillation from the active position to the inactive position. Figures from 6 to 16 only number the pressers 96, 97 and 98 which, according to the direction of rotation 30, are respectively arranged directly upstream of the lowering cam 95, directly upstream of the first cam for lifting to the tuck stitch position 91, and directly downstream of the first cam for lifting to the tuck stitch position 91.

The actuation cams 15 of the connecting elements 19 comprise other cams and other pressers which are not described in detail because they do not play an active part in the operation of the machine during the execution of the method according to the invention.

Conveniently, the cams for lifting the needles to the tuck stitch position 91, 92, the cams for lifting the needles to the drop stitch position 93, 94 and the knockover cams 24 and 25 are fixed, with respect to the lower cam support 75 which is fixed to the supporting structure 2 of the machine, as regards a radial displacement with respect to the lower needle cylinder 4, while the central cam 23 can move on command toward or away from the axis 3 of the lower needle cylinder 4 with respect to the lower cam support 75 in order to interfere or not interfere with the heel 17*a* of the sliders 17.

In substance, as will be better described below, the method according to the invention can be carried out with a machine that, at least for the preparation of the article 80 for its automated pickup, requires only one cam, constituted by the central cam 23, which must be moved on command radially with respect to the lower needle cylinder 4.

For this reason, the machine can have the entire complex of the needle actuation cams considerably simplified, both with regard to the implementation and with regard to actuation.

The knockover cams 24, 25 can be moved on command with respect to the lower cam support 75 along a direction parallel to the axis 3 of the lower needle cylinder 4, in a way that is known per se, in order to vary the density of the knitting during the production of the article 80.

Below the actuation cams 5 of the connecting elements 19, laterally to the lower needle cylinder 4, actuation levers are arranged at a height level such that they are facing toward the heels 20*a* and 20*b* of the selectors 20.

More specifically, there are actuation levers 101*a*, 102*a* and 103*a* which are arranged at a higher level so as to be facing the heels 20*a* of the selectors 20 arranged in one half of the lower needle cylinder 4 and actuation levers 101*b*, 102*b*, 103*b* which are arranged at a lower level so as to be facing the heels 20*b* of the selectors 20 arranged in the other half of the lower needle cylinder 4.

The actuation levers 101*a* and 101*b* are arranged directly upstream of the first cam for lifting to the drop stitch position 93, according to the direction of rotation 30. The actuation levers 102*a*, 102*b* are arranged directly upstream of the lowering cam 95, according to the direction of rotation 30. The actuation levers 103*a*, 103*b* are arranged directly upstream of the first cam for lifting to the tuck stitch position 91, according to the direction of rotation 30.

Each one of these actuation levers can move on command toward the lower needle cylinder 4, in order to interfere with the heel 20*a* or 20*b* of the selectors 20 thus causing the oscillation of the selectors 20 which, in turn, cause the passage of the corresponding connecting elements 19 from the inactive position to the active position, or away from the lower needle cylinder 4 so as to not interfere with the selectors 20 which, in this manner, do not modify the position of the corresponding connecting elements 19.

In Figures from 6 to 16, only the actuation levers that are used during the operation of the machine in the execution of the method according to the invention are numbered. Furthermore, these actuation levers are shown shaded when they are active, and that is to say when are moved close to the lower needle cylinder 4 in order to interfere with the heels 20*a* or 20*b* of the selectors 20, and are shown unshaded when they are not active, and that is to say when they are moved away from the lower needle cylinder 4 in order to not interfere with such heels 20*a* or 20*b*.

Similarly, the central cam 23, in Figures from 6 to 16, is shown with a thick continuous outline when it is active, and that is to say when it is moved close to the lower needle cylinder 4 in order to interfere with the heels 17*a* of the sliders 17, and with a dotted outline when it is not active, and that is to say when it is moved away from the lower needle cylinder 4 in order to not interfere with the heels 17*a* of the sliders 17.

Operation of the machine described above, in the execution of the method according to the invention, will now be described with particular reference to Figures from 6 to 16 and from 6*a* to 16*a*. During the execution of the method, the lower needle cylinder 4 is actuated with a rotary motion about its own axis 3 with respect to the needle actuation cams and to the feed or drop 100, in the direction of rotation indicated by the arrow 30.

In a first step of the method, before the forming of the last row of knitting or, preferably, of some last rows of knitting of the article 80, the needles 8 of the machine which, owing to previous work, had been transferred to the upper needle cylinder 5, are brought back to the lower needle cylinder 4 so that, during the execution of the last row or of some last rows of knitting of the article 80, all the needles of the machine are arranged in the lower needle cylinder 4 with the loops of the row of knitting previously formed hooked, in the upper head 9*a* of the needles 8.

If, owing to previous work, the tensioning tube 63 had been lowered inside the lower needle cylinder 4 in order to perform the tensioning of the locked article 80, with its axial end that was formed first, between the locking element 60 and the upper end of the suck and blow tube 42, the method proceeds by disengaging the locking element 60 from the upper end of the suck and blow tube 42 and progressively retracting the tensioning tube 63 upward until it is completely extracted from the upper end of the lower needle cylinder 4, while the suck and blow tube 42, which is arranged with its upper end below the upper end of the lower needle cylinder 4, is connected to a suction conduit so as to progressively suck the article 80 inside it and keep it adequately tensioned downward.

In this first step, the lower needle cylinder 4 is preferably actuated so as to perform a preparation turn about its own axis 3, forming a row of knitting. This preparation turn is executed with the central cam 23 activated, and that is to say moved close to the axis 3 of the lower needle cylinder 4 in order to interfere with the heels 17*a* of the sliders 17, and with the actuation levers 101*a*, 101*b*, 102*a*, 102*b*, 103*a*, 103*b* also all activated and that is to say moved close to the axis 3 of the lower needle cylinder 4 so as to interfere with the heels 20*a*, 20*b* of the selectors 20. In this manner, as illustrated in FIG. 6, the connecting elements 19, which are brought to the active position by the corresponding selectors 20 pushed by the actuation levers 101*a*, 101*b*, engage with the cam 93 causing the lifting of the sliders 17 and of the corresponding needles 8 which are lifted to the drop stitch position from the cam 93. The connecting elements 19 are then brought to the inactive position by the presser 96 in order to then be returned to the active position following the engagement of the selectors 20 with the activated actuation levers 102*a*, 102*b*. In this manner, the connecting elements 19 engage with their heel 19*a* with the cam 95 which causes a lowering of the connecting elements 19 and therefore of the sliders 17 which engage with their heel 17*a* with the central cam 23 and therefore with the first knockover cam 24. In this manner, the needles 8, after the pickup of the yarn dispensed at the feed 100, are lowered below the knitting forming plane 77, thus forming new loops of knitting and knocking over the previously-formed loops of knitting, as illustrated in FIG. 6*a*. The connecting elements 19 are then pushed into the inactive position by the presser 97 in order to then be brought back again to the active position by the fact that the actuation levers 103*a* and 103*b* are activated, so as to engage with their heel 19*a* with the cam 91 which causes the lifting of the connecting elements 19 and therefore of the sliders 17 which engage with their heel 17*a* with the cam 38 which causes the completion of the lifting of the needles 8 to the tuck stitch position.

Subsequently, a last row of knitting 80*a* is executed by making the lower needle cylinder 4 perform a turn about its own axis 3 while keeping the central cam 23 activated. More specifically, during the first half of the turn, the actuation levers 101*a*, 101*b*, 102*a*, 102*b*, 103*a* are also activated and the actuation lever 103*b* is deactivated, as illustrated in FIG. 7, while, during the second half of the turn, the actuation levers 101*a*, 102*a* are activated and the actuation levers 101*b*, 102*b*, 103*a*, 103*b* are deactivated, as illustrated in FIG. 8. In this manner, the heels 19*a* of the connecting elements 19 engage with the cam 93 and with the cam 95. The heels 17*a* of the sliders 17 engage with the central cam 23, with the first knockover cam 24, and, finally, they pass between the cam 38 and the cam 39. In this manner, the needles 8, first the ones located in a first half of the lower needle cylinder 4 and then the ones located in the second half of the lower needle cylinder 4, after having picked up the yarn dispensed at the feed 100, form the last loop of knitting 80*a* by knocking over the previously-formed loop of knitting and they are brought to the floated stitch position and that is to say with their upper head 9*a*, which holds the last loop of knitting formed, below the knitting forming plane 77, as shown in FIGS. 7*a*, 8*a*.

Subsequently, the actuation levers 101*a*, 101*b*, 102*a*, 102*b*, 103*a*, 103*b* and the central cam 23 are deactivated and that is to say they are moved away from the axis 3 of the lower needle cylinder 4 so as to not interfere respectively with the heels 20*a* and 20*b* of the selectors 20 and with the heels 17*a* of the sliders 17. In this manner, the needles 8 remain in the floated stitch position, as shown in FIGS. 9 and 9*a*.

With the needles 8 in this position, the upper needle cylinder 5 can be moved away laterally from the lower needle cylinder 4 to make room for the pickup device which is positioned above the lower needle cylinder 4.

Subsequently, in a second step of the method according to the invention, the article 80, with the needles 8 in this position, is pushed upward thus performing the lifting of the suck and blow tube 42, as illustrated in FIG. 9*a*.

At this point, by way of execution of another turn of the lower needle cylinder 4 about its own axis 3, all the needles 8 are brought to the tuck stitch position, enacting a third step of the method in question. More specifically, during a first half of the turn of the lower needle cylinder 4, the central cam 23 is deactivated, and the actuation levers 101*a*, 101*b*, 102*a*, 102*b*, 103*a* are also deactivated, and only the actuation lever 103*b* is activated, as illustrated in FIG. 10, while during the second half of the turn the actuation lever 103*a* is also activated, as illustrated in FIG. 11.

During execution of this turn, the needles 8 are not supplied at the feed 100, but the sinkers 33, at the feed 100, move away from the axis 3 of the lower needle cylinder 4 progressively disengaging the article 80 which, following the upward thrust performed by the suck and blow tube 42, is brought with the loops of the last row of knitting 80*a* above the knitting forming plane 77 and above the beak 33*b* of the sinkers 33 toward the upper head 9*a* of the needles 8, thus enacting a fourth step of the method according to the invention.

During execution of this turn of the lower needle cylinder 4 about its own axis 3, the heels 17*a* of the sliders 17 rise onto the upper profile of the second knockover cam 25 bringing the needles 8 to the intermediate position and that is to say to a position comprised between the tuck stitch position and the drop stitch position, as illustrated in FIG. 11, thus enacting a fifth step of the method according to the invention. Due to the fact that the central cam 23 is deactivated, the needles 8 remain in this intermediate position in which the lower end of their latch 10*a* is arranged above the beak 33*b* of the sinkers 33, as shown in FIG. 11*a*.

In FIGS. 12 and 12*a*, the intermediate position has been reached by all the needles 8 and the actuation levers 101*a*, 101*b*, 102*a*, 102*b*, 103*a*, 103*b* have been deactivated with the central cam 23 still deactivated.

It should be noted that the disengagement of the sinkers 33 from the article 80 and the lifting of the needles 8 to the intermediate position are almost simultaneous, although the disengagement of the sinkers 33 from the article 80 begins just before the lifting of the needles 8 to the intermediate position.

In a sixth step of the method according to the invention, the suck and blow tube 42 is lifted further so as to push the last row of knitting 80*a*, hooked by the needles 8, toward the upper head 9*a*, as shown in FIGS. 13 and 13*a*, in order to prevent the loops of knitting of the last row 80*a* from passing below the latch 10*a* in the subsequent step of the method.

Subsequently, in a seventh step of the method according to the invention, by way of execution of another turn of the lower needle cylinder 4 about its own axis 3, all the needles 8 are brought to the drop stitch position. More specifically, during a first half of the turn, with the central cam 23 still deactivated, the actuation levers 101*a*, 102*a*, 102*b*, 103*a*, 103*b* are deactivated and only the actuation lever 101*b* is activated, as illustrated in FIG. 14, while during the second half of the turn the actuation lever 101*a* is also activated, as illustrated in FIG. 15. During the execution of this turn of the lower needle cylinder 4 about its own axis 3, the heels 19*a* of the connecting elements 19 engage with the cam 93, lifting the sliders 17 which, in turn, lift the needles 8 bringing them to the drop stitch position. It should be noted that, during this lifting of the needles 8, the loops of knitting of the last row 80*a* of the article 80 which are located in the upper head 9*a* of the needles 8 do not descend below the latch 10*a*, as shown in FIGS. 14*a* and 15*a*, because the article 80 was previously pushed upward in the previous step.

FIG. 16 shows the completion of the method according to the invention with all the needles 8 in the drop stitch position. The loops of knitting of the last row of knitting 80*a* of the article 80 are kept on the latch 10*a* by virtue of the upward thrust of the article 80 caused by the suck and blow tube 42 and therefore the possibility that the loops of knitting could pass below the latch 10*a* is ruled out.

At this point the rotation of the lower needle cylinder 4 about its own axis 3 is stopped and the article 80 is ready to be picked up by the needles 8 by way of a pickup device provided with pickup elements which are engageable with the shank of the needles 8 below the upper latch 10*a*, for example a pickup device of the type described in international patent applications WO2009/112346 A1 and WO2009/112347 A1.

It should be noted that when all the needles 8 are in the drop stitch position, the central cam 23 can be returned to the active position so as to speed up the subsequent step of restoring, after the picking up of the article 80, in which the needles are lowered. This step of restoring can be carried out by actuating the actuation levers 101*a*, 101*b*, 102*a*, 102*b*, 103*a*, 103*b* in a similar manner to that shown in FIG. 6.

It should also be noted that the lifting of the needles 8 to the intermediate position, in the fifth step of the method according to the invention, achieves two results. A first result is represented by the fact that the knockover cams 24 and 25 can be provided fixed, along a direction radial to the lower needle cylinder 4, with respect to the lower cam support 75. A second result is represented by the fact that the passage by way of an intermediate lifting, in the lifting of the needles 8 from the tuck stitch position to the drop stitch position, avoids placing excessive stress on the knitting and bringing the loops of knitting below the latch 10*a* for those needles 8 that have already been lifted and which are close to needles 8 that are still lowered.

It should be noted furthermore that the diversified actuation of the selectors 20 for the two halves of the lower needle cylinder 4 makes it possible to obtain a high level of precision and reliability in the intervention of the actuation levers 101*a*, 101*b*, 102*a*, 102*b*, 103*a*, 103*b* on the heels 20*a* and 20*b*.

In practice it has been found that the method according to the invention fully achieves the set aim in that, although it is capable of achieving the same result that can be achieved with the method and the machine described in international patent application WO2013/041268 A1, can be carried out with a double cylinder circular machine that is appreciably simpler. In fact, the machine for carrying out the method according to the invention requires only one cam, radially mobile with respect to the needle cylinder, that must be driven: the central cam of the set of knitting forming cams; all the other cams can be provided fixed, unless mobility is required parallel to the axis of the lower needle cylinder of the knockover cams in order to vary the density of the knitting, as explained, with respect to the lower cam support fixed to the supporting structure of the machine, achieving considerable savings both in production costs and in running costs.

Another advantage, deriving from the fact a single type of slider can be used instead of a slider with a short heel and a slider with a long heel, is reducing the number of types of slider and simplifying the maintenance operations, as well as eliminating the need for cams with two stages of operation with a reduction in the overall cost of production of the machine and an increase in its reliability.

The method and the machine for its execution, thus conceived, are susceptible of numerous modifications and variations, all of which are within the scope of the appended claims; thus, for example, the selectors can be actuated by way of conventional selection devices instead of by way of the actuation levers 101*a*, 101*b*, 102*a*, 102*b*, 103*a*, 103*b*.

Moreover, all the details may be substituted by other, technically equivalent elements.

In practice the materials employed, and the dimensions, may be any according to requirements and to the state of the art.

The disclosures in Italian Patent Application No. 102015000071276 (UB2015A005479) from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A method for preparing a tubular article, for automated pickup at the end of its forming on a double cylinder circular machine with at least one feed or drop and with the needle cylinders actuatable with a rotary motion about their own axes with respect to needle actuation cams, for actuating the knockover sinkers, and to said feed or drop, comprising at least the following steps:

a first step, which consists in transferring or retaining all the needles in the lower needle cylinder with the loops of the last row of knitting of the article, formed previously in the upper head of the needles, hooked, tensioning the article downward inside the lower needle cylinder;

a second step, which consists in pushing upward the portion of the article engaged with the needles;

a third step, which consists in moving all the needles to the tuck stitch position;

a fourth step, which consists in progressively disengaging the knockover sinkers from the article, moving the knockover sinkers away from the axis of the lower needle cylinder at said feed or drop owing to the rotation of the lower needle cylinder about its own axis with respect to said feed or drop and to said needle actuation cams so that said article, owing to the upward thrust, moves so that the loops of its last row of knitting lie above the beak of the knockover sinkers toward the upper head of the needles;

a fifth step, which consists in moving all the needles to an intermediate position that is comprised between the tuck stitch position and the drop stitch position;

a sixth step, which consists in pushing the portion of the article that is engaged with the needles further upward;

a seventh step, which consists in lifting the needles at least to the drop stitch position, keeping the article pushed upward in order to retain the loops of the last row of knitting in the upper head of the needles.

2. The method according to claim 1, wherein after said first step and before said second step it comprises the following intermediate steps:

a first intermediate step, which consists in moving all the needles to the floated stitch position with their upper head below the knitting forming plane or knockover plane defined by the knockover sinkers; said knockover sinkers being closer with their beak to the axis of the lower needle cylinder except for the knockover sinkers located proximate to said at least one feed or drop of the machine;

a second intermediate step, which consists in moving the upper needle cylinder away laterally with respect to the lower needle cylinder.

3. The method according to claim 2, wherein in said first intermediate step the needles are moved to the floated stitch position by the action of the needle actuation cams, actuating the lower needle cylinder with a rotary motion about its own axis with respect to said needle actuation cams and to said feed or drop, forming a last row of knitting with all the needles.

4. The method according to claim 1, wherein in said third step the needles are moved from the floated stitch position to the tuck stitch position by the action of the needle actuation cams, actuating the lower needle cylinder with a rotary motion about its own axis with respect to said needle actuation cams and to said feed or drop.

5. The method according to claim 1, wherein in said fifth step the needles are moved from the tuck stitch position to the intermediate position by the action of the needle actuation cams, actuating the lower needle cylinder with a rotary motion about its own axis with respect to said needle actuation cams and to said feed or drop.

6. The method according to claim 1, wherein in said seventh step the needles are moved from the intermediate position to the drop stitch position by the action of the needle actuation cams, actuating the lower needle cylinder with a rotary motion about its own axis with respect to said needle actuation cams and to said feed or drop.

7. A double cylinder circular hosiery knitting machine for performing the method according to claim 1, which comprises a supporting structure which supports, so that it can rotate about its own, vertically oriented, axis, a lower needle cylinder and an upper needle cylinder, which can be positioned above and coaxially to the lower needle cylinder; a plurality of axial grooves being defined on the lateral surface of said lower needle cylinder and on the lateral surface of said upper needle cylinder; each one of the axial grooves of the lower needle cylinder, with said upper needle cylinder arranged coaxially to said lower needle cylinder, being aligned with an axial groove of the upper needle cylinder and accommodating a needle which can translate on command from said lower needle cylinder to said upper needle cylinder or vice versa; elements for actuating the corresponding needle when it is positioned in said lower needle cylinder being arranged in each one of the axial grooves of said lower needle cylinder, and elements for actuating the corresponding needle when it is positioned in said upper needle cylinder being arranged in each one of the axial grooves of said upper needle cylinder; actuation cams for the needles which are engageable with said actuation elements of the needles arranged in the axial grooves of said lower needle cylinder and of said upper needle cylinder being arranged around said lower needle cylinder and around said upper needle cylinder; knockover sinkers being accommodated inside said lower needle cylinder and arranged with their beak between two contiguous axial grooves and movable with their beak toward or away with respect to the axis of the lower needle cylinder; actuation cams for the knockover sinkers being provided which define at least one path that can be followed by a heel of the knockover sinkers as a consequence of the rotation of the lower needle cylinder with respect to said actuation cams of the knockover sinkers and which is contoured to move the knockover sinkers with their beak toward or away with respect to the axis of the lower needle cylinder; said actuation elements of the needles arranged in the lower needle cylinder comprising, in each one of the axial grooves of the lower needle cylinder, a slider provided with an upper end that is engageable with the lower head of the corresponding needle and provided with a heel that protrudes from the lateral surface of the lower needle cylinder and is engageable with actuation cams of the sliders, which face the lateral surface of the lower needle cylinder; said actuation elements of the needles arranged in the lower needle cylinder comprising, in each one of the axial grooves of the lower needle cylinder, a connecting element which is connected, by way of the upper end thereof, to the corresponding slider arranged above said connecting element in said axial groove of the lower needle cylinder; said connecting element being provided with a movable heel which is directed toward the outside of the lower needle cylinder and being able to oscillate on a radial plane of the lower needle cylinder in order to engage, by way of said movable heel, with actuation cams of the connecting elements that face the lateral surface of the lower needle cylinder or in order to disengage from said actuation cams of the connecting elements; said actuation cams of the sliders comprising a set of knitting forming cams which is arranged at said feed or drop and is composed of two knockover cams which are arranged on mutually opposite sides with respect to a central plane that passes through the axis of the lower needle cylinder and a central cam which is arranged above said knockover cams between said knockover cams; wherein said actuation cams of the connecting elements comprise at least one cam for lifting the needles to the tuck stitch position and at least one cam for lifting the needles to the dropped stitch position, said at least one cam for lifting the needles to the tuck stitch position, said at least one cam for lifting the needles to the dropped stitch position and said knockover cams being fixed, with respect to a corresponding lower cam support which is fixed to the supporting structure of the machine, as regards a radial displacement with respect to the lower needle cylinder, said central cam being movable on command toward or away from the axis of the lower needle cylinder with respect to said lower cam support in order to interfere or not interfere with the heel of the sliders.

* * * * *